US006328832B1

(12) United States Patent
Otruba et al.

(10) Patent No.: US 6,328,832 B1
(45) **Date of Patent: *Dec. 11, 2001**

(54) LABELING APPARATUS WITH WEB REGISTRATION, WEB CUTTING AND CARRIER MECHANISMS, AND METHODS THEREOF

(75) Inventors: Svatoboj Otruba, Ceres; Ranbir Singh Claire, Livingston, both of CA (US)

(73) Assignee: S-CON, Inc., Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 22 days.

(21) Appl. No.: 09/105,876

(22) Filed: Jun. 26, 1998

(51) Int. Cl.[7] ..... B32B 31/20; B32B 31/18; B65C 3/12; B65C 9/10

(52) U.S. Cl. ..... 156/64; 156/215; 156/270; 156/354; 156/355; 156/353; 156/566

(58) Field of Search ..... 156/52, DIG. 9, 156/353, 354, 250, 270, 285, DIG. 24, DIG. 28, DIG. 33, 556, 566, 64, 212, 215, 355; 427/208.4, 207.1; 83/346, 349, 337, 343

(56) References Cited

U.S. PATENT DOCUMENTS

| | | | |
|---|---|---|---|
| 787,744 | 4/1905 | Fisher et al. | 156/451 |
| 1,691,027 | 11/1928 | Novick | 83/312 |

(List continued on next page.)

FOREIGN PATENT DOCUMENTS

| | | |
|---|---|---|
| 1961419 | 6/1967 | (DE) . |
| 1255567 | 11/1967 | (DE) . |

(List continued on next page.)

OTHER PUBLICATIONS

Dow Chemical Company's, Technical Information for Opticite 320 Film.

Dow Chemical Company's, Technical Information for Opticite 350 Film.

(List continued on next page.)

*Primary Examiner*—Linda Gray
(74) *Attorney, Agent, or Firm*—Wood, Herron & Evans, L.L.P.

(57) ABSTRACT

An apparatus and method utilize a rotatable drum implementing both an attraction mechanism and a cutter mechanism to controllably sever segments of material from a web. The drum is rotated at a rate greater than the rate at which the web of material is advanced so that the attraction mechanism supplies the sole source of tension in the web. Moreover, the cutter mechanism severs segments of material while at least a portion of the web of material engages the outer surface of the drum. In addition, an apparatus and method dynamically control the relative rates of advancement of a web of material and an outer surface of a drum such that a predetermined length of material is advanced forward of a predetermined rotational position of the drum so that the predetermined length of material is severed from the web of material while at least a portion of the web of material engages the outer surface of the drum. Moreover, an apparatus and method may utilize a carrier mechanism having at least one article carrier pivotably coupled to a rotatable hub and controlled via a camming mechanism that varies the angular velocity of the article carrier relative to that of the hub. The hub rotates about a first axis, and the pivotal coupling between the article carrier and the hub defines a second axis that is substantially parallel to and separated from the first axis. The camming mechanism is operatively coupled between the article carrier and the hub and configured to pivot the article carrier about the second axis in response to rotation of the hub about the first axis to thereby vary the angular velocity of the article carrier relative to that of the hub.

61 Claims, 13 Drawing Sheets

U.S. PATENT DOCUMENTS

| | | | | |
|---|---|---|---|---|
| 1,696,329 | | 12/1928 | Saatman | 118/245 |
| 1,922,767 | | 8/1933 | Humphner | 40/2 |
| 1,986,039 | | 1/1935 | Ackley | 91/50 |
| 2,214,096 | | 9/1940 | Weiss | 216/55 |
| 2,347,445 | | 4/1944 | Von Hofe | 91/50 |
| 2,585,250 | | 2/1952 | Jones et al. | 216/21 |
| 2,609,926 | | 9/1952 | Hartig et al. | 209/524 |
| 2,613,168 | | 10/1952 | Totten, Jr. | 154/46 |
| 2,773,617 | | 12/1956 | Weiss | 216/13 |
| 3,045,643 | | 7/1962 | Mattingly et al. | 118/415 |
| 3,091,245 | | 5/1963 | Rudszinat et al. | 131/94 |
| 3,140,573 | | 7/1964 | Buttolph | 53/51 |
| 3,247,744 | | 4/1966 | Huck et al. | 83/107 |
| 3,264,984 | | 8/1966 | Smith, Jr. | 101/227 |
| 3,431,830 | * | 3/1969 | Stovall | 83/343 |
| 3,542,229 | | 11/1970 | Waltenhofen et al. | 215/1 |
| 3,557,933 | | 1/1971 | Sopher | 198/33 |
| 3,562,050 | | 2/1971 | Hake et al. | 156/215 |
| 3,601,587 | | 8/1971 | Thiede | 235/92 CC |
| 3,648,911 | | 3/1972 | Pekrul | 226/30 |
| 3,657,043 | | 4/1972 | Ploetz et al. | 156/196 |
| 3,690,997 | | 9/1972 | Bofinger et al. | 156/567 |
| 3,739,968 | | 6/1973 | Bodendoerfer | 226/30 |
| 3,750,511 | | 8/1973 | Toensing | 83/337 |
| 3,765,991 | | 10/1973 | Hoffmann | 156/521 |
| 3,794,048 | | 2/1974 | Mollins et al. | 131/94 |
| 3,834,963 | | 9/1974 | Hoffman | 156/215 |
| 3,841,216 | | 10/1974 | Huffman | 101/181 |
| 3,864,187 | | 2/1975 | Carter | 156/364 |
| 3,905,859 | | 9/1975 | Patterson | 156/443 |
| 3,931,902 | | 1/1976 | Love, Jr. | 214/390 |
| 3,949,949 | | 4/1976 | Thompson | 242/75.43 |
| 3,955,020 | | 5/1976 | Cavanagh et al. | 428/35 |
| 3,963,557 | | 6/1976 | Patterson | 156/519 |
| 3,972,428 | | 8/1976 | Love, Jr. et al. | 214/85 |
| 4,027,426 | | 6/1977 | Wallding et al. | 40/310 |
| 4,032,388 | | 6/1977 | Dunning | 156/568 |
| 4,045,275 | | 8/1977 | Stohlquist et al. | 156/521 |
| 4,104,845 | | 8/1978 | Hoffmann | 53/14 |
| 4,108,706 | | 8/1978 | Brands et al. | 156/384 |
| 4,108,709 | | 8/1978 | Hoffmann | 156/446 |
| 4,108,710 | | 8/1978 | Hoffmann | 156/450 |
| 4,108,711 | | 8/1978 | Hoffmann | 156/497 |
| 4,121,961 | | 10/1978 | Brunette et al. | 156/249 |
| 4,174,237 | | 11/1979 | Hemming, Jr. et al. | 156/64 |
| 4,181,555 | | 1/1980 | Hoffmann | 156/265 |
| 4,188,843 | | 2/1980 | Dickey | 83/304 |
| 4,216,044 | | 8/1980 | Herdzina et al. | 156/215 |
| 4,221,144 | | 9/1980 | Diesch et al. | 83/27 |
| 4,240,863 | | 12/1980 | Vinton | 156/361 |
| 4,242,167 | | 12/1980 | Hoffmann | 156/357 |
| 4,248,655 | | 2/1981 | Kerwin | 156/351 |
| 4,253,899 | | 3/1981 | Takemoto et al. | 156/277 |
| 4,264,957 | | 4/1981 | Pautzke | 364/469 |
| 4,273,816 | | 6/1981 | Tollette | 428/35 |
| 4,288,280 | | 9/1981 | Morin | 156/510 |
| 4,293,365 | | 10/1981 | Geyser et al. | 156/364 |
| 4,295,915 | | 10/1981 | Sakaguchi et al. | 156/361 |
| 4,300,966 | | 11/1981 | Hoffmann | 156/156 |
| 4,314,869 | | 2/1982 | Crankshaw | 156/215 |
| 4,316,566 | | 2/1982 | Arleth et al. | 226/2 |
| 4,336,095 | | 6/1982 | Hoffmann | 156/361 |
| 4,339,092 | | 7/1982 | Benoy et al. | 242/56 R |
| 4,361,260 | | 11/1982 | Hanlan | 226/30 |
| 4,395,300 | | 7/1983 | Hoffmann | 156/294 |
| 4,404,880 | | 9/1983 | DeLuca | 83/42 |
| 4,406,721 | | 9/1983 | Hoffmann | 156/86 |
| 4,416,714 | | 11/1983 | Hoffmann | 156/86 |
| 4,425,866 | | 1/1984 | Hoffmann | 118/58 |
| 4,469,548 | | 9/1984 | Jörss | 156/567 |
| 4,500,386 | | 2/1985 | Hoffman | 156/449 |
| 4,519,868 | | 5/1985 | Hoffmann | 156/353 |
| 4,526,645 | | 7/1985 | Malthouse et al. | 156/350 |
| 4,545,832 | | 10/1985 | Hoffmann | 156/86 |
| 4,552,608 | | 11/1985 | Hoffmann et al. | 156/351 |
| 4,554,774 | | 11/1985 | Miyashita et al. | 53/52 |
| 4,561,928 | | 12/1985 | Malthouse | 156/497 |
| 4,566,933 | | 1/1986 | Crankshaw et al. | 156/444 |
| 4,567,681 | | 2/1986 | Fumei | 40/310 |
| 4,574,020 | | 3/1986 | Fosnaught | 156/80 |
| 4,592,796 | | 6/1986 | Schlacht | 156/450 |
| 4,604,154 | | 8/1986 | Fosnaught | 156/264 |
| 4,629,528 | | 12/1986 | Tanaka et al. | 156/351 |
| 4,632,721 | | 12/1986 | Hoffmann et al. | 156/458 |
| 4,641,558 | | 2/1987 | Hoffmann | 83/152 |
| 4,671,843 | | 6/1987 | Olsen | 156/450 |
| 4,685,318 | | 8/1987 | Ueda et al. | 72/185 |
| 4,687,535 | | 8/1987 | Voltmer | 156/361 |
| 4,704,173 | | 11/1987 | Hoffmann | 156/86 |
| 4,724,029 | | 2/1988 | Kontz | 156/256 |
| 4,735,668 | | 4/1988 | Hoffmann et al. | 156/215 |
| 4,758,300 | | 7/1988 | King et al. | 156/357 |
| 4,763,823 | | 8/1988 | Eder et al. | 226/109 |
| 4,763,930 | | 8/1988 | Matney | 283/81 |
| 4,781,317 | | 11/1988 | Ditto | 226/27 |
| 4,835,720 | | 5/1989 | Ditto et al. | 364/561 |
| 4,842,660 | | 6/1989 | Voltmer et al. | 156/64 |
| 4,844,957 | | 7/1989 | Hoffmann | 428/34.7 |
| 4,864,631 | | 9/1989 | Jensen | 382/61 |
| 4,872,931 | | 10/1989 | Mitchell | 156/86 |
| 4,922,775 | | 5/1990 | Winter | 83/333 |
| 4,923,557 | | 5/1990 | Dickey | 156/86 |
| 4,931,122 | | 6/1990 | Mitchell | 156/215 |
| 4,956,987 | | 9/1990 | Hara et al. | 72/185 |
| 4,977,002 | | 12/1990 | Hoffman | 428/34.7 |
| 4,978,416 | | 12/1990 | Potter et al. | 156/571 |
| 4,982,887 | | 1/1991 | Takahashi | 226/24 |
| 4,985,096 | | 1/1991 | Bekker-Madsen | 156/64 |
| 4,998,835 | | 3/1991 | Negishi et al. | 400/611 |
| 5,017,261 | | 5/1991 | Zodrow et al. | 156/568 |
| 5,024,717 | | 6/1991 | Winter | 156/354 |
| 5,030,306 | | 7/1991 | Lastra | 156/215 |
| 5,030,311 | | 7/1991 | Michal et al. | 156/256 |
| 5,037,499 | | 8/1991 | Bright et al. | 156/456 |
| 5,045,140 | | 9/1991 | Dickey | 156/215 |
| 5,062,917 | | 11/1991 | Zodrow | 156/568 |
| 5,082,105 | | 1/1992 | Tincati | 198/473.1 |
| 5,082,520 | | 1/1992 | West et al. | 156/450 |
| 5,091,040 | | 2/1992 | Otruba | 156/566 |
| 5,102,485 | | 4/1992 | Keeler et al. | 156/256 |
| 5,116,452 | | 5/1992 | Eder | 156/566 |
| 5,129,568 | | 7/1992 | Fokos et al. | 226/27 |
| 5,137,596 | | 8/1992 | Potter | 156/497 |
| 5,160,570 | | 11/1992 | Dickey | 156/448 |
| 5,224,640 | | 7/1993 | Fokos et al. | 226/27 |
| 5,227,005 | | 7/1993 | Zodrow et al. | 156/566 |
| 5,235,515 | | 8/1993 | Ungpiyakul et al. | 364/469 |
| 5,240,529 | | 8/1993 | Hoffmann | 156/86 |
| 5,256,239 | | 10/1993 | Volter et al. | 156/362 |
| 5,269,864 | | 12/1993 | Otruba | 156/215 |
| 5,271,783 | | 12/1993 | Potter | 156/86 |
| 5,286,317 | | 2/1994 | Treat et al. | 156/64 |
| 5,309,695 | | 5/1994 | Frabetti et al. | 53/136.1 |
| 5,344,519 | | 9/1994 | Galchefski et al. | 156/456 |
| 5,361,960 | | 11/1994 | Fokos et al. | 226/2 |
| 5,375,395 | | 12/1994 | Gmeiner | 53/493 |
| 5,380,381 | | 1/1995 | Otruba | 156/64 |
| 5,399,216 | | 3/1995 | Galchefski et al. | 156/215 |
| 5,403,416 | | 4/1995 | Bright et al. | 156/86 |
| 5,403,635 | | 4/1995 | Hoffman | 428/34.7 |
| 5,405,487 | | 4/1995 | Galchefski et al. | 156/566 |

| | | | | |
|---|---|---|---|---|
| 5,413,651 | | 5/1995 | Otruba | 156/64 |
| 5,437,759 | | 8/1995 | Westbury | 156/566 |
| 5,441,210 | | 8/1995 | Hinton | 242/421.1 |
| 5,455,764 | | 10/1995 | Meihofer | 364/161 |
| 5,458,729 | | 10/1995 | Galchefski et al. | 156/566 |
| 5,464,495 | | 11/1995 | Eder | 156/456 |
| 5,470,300 | | 11/1995 | Terranova | 493/11 |
| 5,472,552 | | 12/1995 | Speranza et al. | 156/351 |
| 5,478,422 | | 12/1995 | Bright et al. | 156/64 |
| 5,486,253 | | 1/1996 | Otruba | 156/215 |
| 5,491,010 | | 2/1996 | Eder | 428/35.7 |
| 5,501,066 | | 3/1996 | Errasti Iriarte et al. | 53/556 |
| 5,533,608 | | 7/1996 | Adams et al. | 198/478.1 |
| 5,538,575 | | 7/1996 | Hinton | 156/215 |
| 5,635,004 | * | 6/1997 | Pazdernik | 156/227 |
| 5,702,559 | | 12/1997 | Bright | 156/450 |
| 5,741,381 | | 4/1998 | Dolence et al. | 156/64 |
| 5,753,350 | | 5/1998 | Bright | 428/195 |
| 5,772,001 | | 6/1998 | Otruba et al. | 198/459.2 |
| 5,785,803 | | 7/1998 | Schiessl | 156/538 |
| 5,821,724 | | 10/1998 | Hinton | 318/798 |
| 5,855,710 | | 1/1999 | Hinton | 156/86 |
| 5,858,143 | | 1/1999 | Bright et al. | 156/86 |
| 5,858,168 | | 1/1999 | Hinton | 156/566 |
| 5,863,382 | | 1/1999 | Hinton | 156/510 |
| 5,897,722 | | 4/1999 | Bright | 156/86 |
| 5,915,612 | | 6/1999 | Hinton | 226/30 |
| 5,922,422 | | 7/1999 | Otruba | 428/34.1 |
| 5,964,974 | | 10/1999 | Hinton | 200/61.62 |
| 5,964,975 | | 10/1999 | Hinton | 200/61.88 |

FOREIGN PATENT DOCUMENTS

| | | |
|---|---|---|
| 1436046 | 10/1968 | (DE) . |
| 2049508 | 4/1971 | (DE) . |
| 3529716 | 5/1987 | (DE) . |
| 4314142 | 7/1994 | (DE) . |
| 19654350 | 6/1998 | (DE) . |
| 0 009 739 | 4/1980 | (EP) . |
| 0 011 967 | 6/1980 | (EP) . |
| 0 074 165 | 3/1983 | (EP) . |
| 0 441 617 A1 | 8/1991 | (EP) . |
| 0 630 723 A2 | 12/1994 | (EP) . |
| 0 787 667 | 6/1997 | (EP) . |
| 313679 | 6/1929 | (GB) . |
| 777133 | 6/1957 | (GB) . |
| 2 096 795 A | 10/1982 | (GB) . |
| 2 187 163 | 3/1987 | (GB) . |
| 58-147635 | 9/1983 | (JP) . |
| 0075322 | 3/1989 | (JP) . |
| 40-4173619 | 6/1992 | (JP) . |
| 6-99961 | 4/1994 | (JP) . |
| 93/21071 | 10/1993 | (WO) . |
| 94/15842 | 7/1994 | (WO) . |
| 95/16612 | 6/1995 | (WO) . |
| 97/10953 | 3/1997 | (WO) . |
| 97/48608 | 12/1997 | (WO) . |
| 98/00339 | 1/1998 | (WO) . |

OTHER PUBLICATIONS

Dow Chemical Company's, Technical Information for Opticite 620 Film.

Pacific Scientific, Product Literature for "Tough SC700 . . . One Tough Servo".

Pacific Scientific, Product Literature for "SC750 Series".

Burr–Brown, Product Literature for TM2500/TM2700 OEM Microterminals (1987).

Product Literature for E.M.P. Model #2 Solid State Two–Way Preprint Registration Cut–Off Control Systems.

Lauricare™ Teat Dip Concentrate (34–7030–4074–0) Label, (3M. St Paul, Minnesota).

Coleman® 2 Liter Jug Label (5590C408), (Coleman Outdoor Products, Witchita, Kansas).

Zep® Reach Hand Cleaner Label (1288B), (Zep Mfg. Col, Atlanta, Georgia).

Original New York Seltzer® Raspberry Flavor Label (ZR–E913–MR10BC 9 5), (New York Selzer Co., Walnut, California).

Clear Cola Crystal Pepsi® (7A–461) Label.

diet Coke Label (1991–2522 2L), (The Coca–Cola Company).

Sunny Delight® Orange Juice Label.

BH2000 Product Literature, B & H Manufacturing, Inc. (1984), 1 page.

BJ2300 Product Literature, B & H Manufacturing, Inc. (1986), 1 page.

BH200 Product Literature, B & H Manufacturing, Inc. (at least 1984), 2 pages.

Trine Quick Change 4500 Product Literature, *Trine Labeling Systems*, (1997), 4 pages.

Metzger, Brian, *Trine Quick Change 4500*, (product on sale since at least 1997), 1 page.

MR Etikettiertechnik, GmbH & Co. Product Literature, (product on sale since at least 1997), 3 pages.

Trine 5500 Product Literature, Trine Manufacturing Co., (at least 1984), 10 pages.

NJM Thorobred ® 350 Brochure, NJM Inc., (at least 1979), 2 pages.

"New Products, New Plants, New People: NJM Broadens Base with Expanded Line at Lower Prices", *Good Packaging*, NJM, (at least 1979), p. 8.

* cited by examiner

LABELING APPARATUS WITH WEB REGISTRATION, WEB CUTTING AND CARRIER MECHANISMS, AND METHODS THEREOF

FIELD OF THE INVENTION invention is generally related to web registration and product handling. More particularly, the invention is generally related to registering a moving web with one or more moving products, e.g., for applying labels to containers.

BACKGROUND OF THE INVENTION

In a great number of consumer product markets, particularly those which are low-margin and/or price-driven, an ongoing need exists for various manners of reducing product costs. For example, just-in-time manufacturing techniques, which reduce costs through minimizing inventory, have grown in prominence. In addition, improved packaging techniques and materials are constantly being developed to minimize the packaging component of product costs.

Just-in-time manufacturing can place significant demands on product manufacturing and packaging equipment due to the quick turnaround that is often required to timely fill customer orders. As a result, there is an ongoing need for a manner of increasing the speed of product manufacturing and packaging equipment so that inventory costs can be reduced without adversely impacting a manufacturer's ability to fill customer orders in a timely fashion.

For example, for bottled beverages such as soft drinks, beer, juice, liquor, etc., significant efforts have been expended in attempting to lower the costs associated with applying product labels to beverage containers such as glass bottles, plastic bottles, aluminum cans, and the like. A particularly cost-effective manner of labeling beverage containers utilizes a continuous web of pre-printed polymer label material that is cut into predetermined lengths, supplied with adhesive, and applied directly to the surface of a container. Adhesive costs may also be reduced by applying adhesive only to the leading and trailing edges of individual labels and wrapping the labels completely around the containers.

Label machines have been developed that are capable of relatively high-speed operation, e.g., as high as 750 containers/minute or more. However, such machines have been found to be limited in several respects.

One significant problem associated with such conventional labeling machines is that it is difficult to reliably control tension in a web of label material being processed at high speed. Among other concerns, a large roll of label material spun at high speed has a great deal of momentum, which often necessitates a dedicated tensioning mechanism between a supply of label material and a cutting mechanism. A tensioning mechanism, however, can introduce variable tensions at different points along the web, not to mention adding complexity and increasing the cost of the machines. Moreover, in many conventional label machine designs, separate cutting and transfer (or vacuum) drums are utilized, with the web at least partially drawn to a downstream transfer drum prior to severing a label from the web with an upstream cutting drum—an arrangement that can introduce variable tension to the web before and after cutting.

As a result of these tensioning concerns, most conventional labeling machines require that a non-stretchable polymer film such as polypropylene or polystyrene be used as the web material. Stretchable polymer films such as polyethylene are often unsuitable for use with such machines because the varied tensions in the web can stretch such films lengthwise and introduce unacceptable positioning errors when cutting the web. Web material constructed from non-stretchable polypropylene or polystyrene, however, can be three or four times more expensive than a stretchable material such as polyethylene. As a result, many conventional labeling machines prohibit the ability of a producer to take advantage of the substantial savings that could otherwise be realized through the use of less expensive films.

Therefore, a significant need exists in the art for an improved manner controlling tension in a web of material, particularly when supplying a web of label material in high speed labeling machines and the like. Moreover, a significant need exists for a manner of controlling web tension such that less expensive stretchable polymer films may be utilized in high speed labeling applications.

The process of conveying articles such as containers past a label transport drum introduces another significant problem associated with conventional labeling machines, as well as with other machinery that utilizes multiple stations that require different transport parameters at different stations. For example, with regard to labeling machines, many conventional labeling machine designs utilize turrets or star wheels to convey individual articles past a label transfer drum at a controlled rate and with a controlled separation, or "pitch", between sequential articles so that each article is initially presented to the transfer drum at a position thereon where a leading edge of a label is located. A turret is typically a rotatable body that includes mechanisms disposed about the periphery for gripping articles from the top and bottom ends thereof. A star wheel is typically a rotatable body that includes pockets disposed around its periphery that contact the sides of articles to advance the articles through the machine. Articles moving past a transfer drum are typically rotated as they pass the transfer drum (e.g., by virtue of contact between the drum and a fixed guide) so that labels on the drum are wrapped around the articles.

Turrets typically provide the greatest degree of precision in handling and transporting articles. However, due to the additional components and coordinated movements required to bring top and/or bottom gripping mechanisms into contact with articles, turrets are relatively slow and expensive. Star wheels are typically faster and less expensive, but have the drawback that articles are not held as securely and can become misaligned within the star wheels.

For example, star wheels are typically used in conjunction with a moving conveyor that supports the articles and moves at a fixed linear velocity. A label transfer drum then rotates with its outer surface traveling in the same direction as the conveyor. The velocities of the pockets in the star wheel and the outer surface of the drum are typically matched so that an article contacts a label on the drum while each is traveling at the same velocity. The articles may also be rolled or spun about its longitudinal axis to wrap the label around the article—typically by passing the article by a fixed guide or contacting the article with a relatively faster-moving belt.

Given that the leading edges of successive labels are spaced apart from one another along the outer surface of the transfer drum, it is often necessary for articles to be spaced apart with the proper pitch to ensure proper alignment of articles and labels. This typically requires that the star wheel and transfer drum rotate in such a manner that the articles and labels travel faster than the conveyor. However, unless the linear velocities of the articles are identical to that of the conveyor, the articles may become tilted within the pockets of the star wheel due to friction as the articles slide along the surface of the conveyor. As a result, applied labels may have loose or bunched-up portions due to the misalignment of the articles relative to the labels.

Moreover, other than when the labels are actually applied, it is often desirable to minimize the rotation of articles while disposed upon the conveyors so that the articles are conveyed in a more controlled manner. Conventional star wheels, which operate at a constant velocity, are often not capable of adequately controlling the rate of rotation of articles, which can result in label mis-registration and/or article jams at high speed.

Some conventional designs also incorporate feed screws at the entry and/or discharge ends of a label application station to convey the articles in a linear direction. The feed screws may also have variable pitches to control the linear velocity of the articles, and thus the separation between articles. However, feed screws also are unable to accurately control the rotational rates of articles, and thus, label mis-registration and/or article jams still remain a significant concern.

Therefore, a significant need also exists for an improved manner of conveying articles such as containers past a transfer drum in high speed applications, in particular so that the movement of such articles are carefully controlled.

SUMMARY OF THE INVENTION

The invention addresses these and other problems associated with the prior art by providing in one aspect an apparatus and method that utilize a rotatable drum implementing both an attraction mechanism and a cutter mechanism to controllably sever segments of material from a web. The drum is rotated at a rate greater than the rate at which the web of material is advanced so that the attraction mechanism supplies the sole source of tension in the web. Moreover, the cutter mechanism severs segments of material while at least a portion of the web of material engages the outer surface of the drum. As such, the outer surface of the drum tends to slide relative to the leading edge of the web, with the attraction mechanism operating to apply a controlled pulling force thereto. Among other advantages, this permits less-expensive stretchable web material to be utilized, thereby lowering material costs. Moreover, greater reliability at high speeds is also often realized—an important consideration for many just-in-time manufacturing applications.

The invention also addresses additional problems associated with the prior art by providing in another aspect an apparatus and method that dynamically control the relative rates of advancement of a web of material and an outer surface of a drum such that a predetermined length of material is advanced forward of a predetermined rotational position of the drum so that the predetermined length of material is severed from the web of material while at least a portion of the web of material engages the outer surface of the drum. The rate of advancement of the outer surface of the drum is different from that of the web of material such that relative slippage of the web of material and the outer surface of the drum is provided. As such, a web of material may be controllably severed into predetermined lengths using a relatively mechanically-simple configuration, which aids in accuracy and reliability, particularly in high speed applications.

The invention further addresses additional problems associated with the prior art by providing in another aspect an apparatus and method that utilize a carrier mechanism having at least one article carrier pivotably coupled to a rotatable hub and controlled via a camming mechanism that varies the angular velocity of the article carrier relative to that of the hub. The article carrier is configured to receive and transfer an article along an article engaging surface of a fixed guide. The hub rotates about a first axis, and the pivotal coupling between the article carrier and the hub defines a second axis that is substantially parallel to and separated from the first axis. The clamming mechanism is operatively coupled between the article carrier and the hub and configured to pivot the article carrier about the second axis in response to rotation of the hub about the first axis to thereby vary the angular velocity of the article carrier relative to that of the hub.

Through the use of the above configuration, the carrier mechanism may be configured to match predetermined transport parameters associated with each of first and second stations that the carrier mechanism transports articles between. In one embodiment, the predetermined transport parameters may be based upon the pitch between sequential articles processed by each of the first and second stations so that the pitch of the articles transported by the carrier mechanism may be controlled to match that expected by each of the stations. In another embodiment, the predetermined transport parameters may be based upon the velocity of each article processed by the first and second stations so that the velocities of the articles transported by the carrier mechanism may be controlled to match those expected by each of the stations. As a result, greater control is provided over transported articles to permit high speed operation with greater reliability.

These and other advantages and features, which characterize the invention, are set forth in the claims annexed hereto and forming a further part hereof. However, for a better understanding of the invention, and of the advantages and objectives attained through its use, reference should be made to the drawings, and to the accompanying descriptive matter, in which there is described exemplary embodiments of the invention.

DETAILED DESCRIPTION

Figure 1:
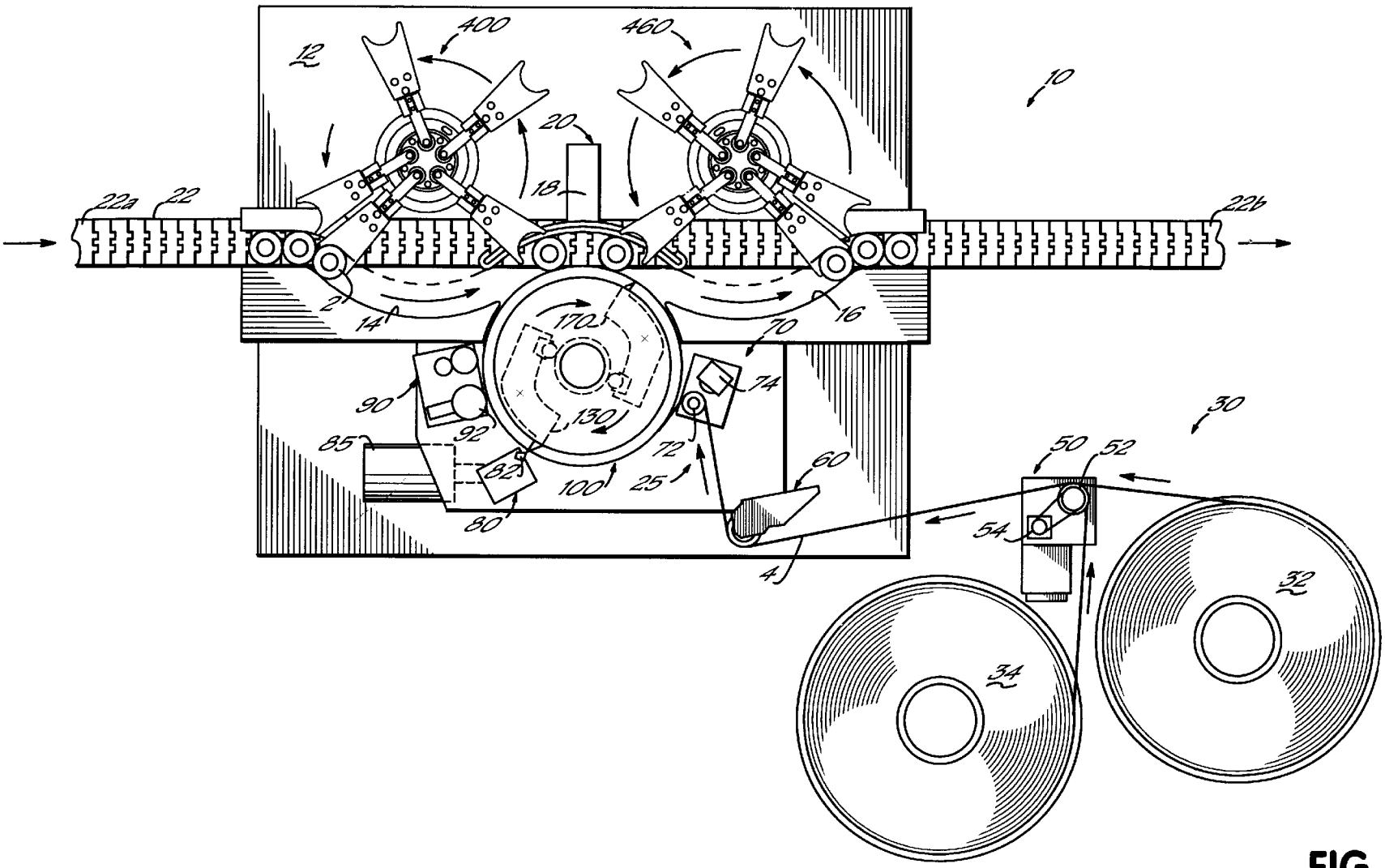
FIG. 1 is a top plan view of a labeling apparatus consistent with the invention.

Turning to the Drawings, wherein like numbers denote like parts throughout the several views, FIG. 1 illustrates a labeling apparatus 10 consistent with the principles of the invention. Apparatus 10 is principally used to apply labels in a continuous fashion to a plurality of articles 2 conveyed via an article transport mechanism (e.g., a conveyor 22) from an entrance end 22*a* to an exit or discharge end 22*b*. Apparatus 10 may be utilized with any number of article designs, including various containers with upright cylindncal portions, e.g., cans or bottles. The articles may be suitable for use in packaging beverages or foodstuffs, or any other type of packaged goods. For example, one suitable application of apparatus 10 is in applying labels to single-serving plastic soft drink bottles, among others.

Articles 2 are conveyed past a label application assembly or mechanism 25 using a pair of carrier mechanisms 400, 460, which are described in greater detail below. Carrier mechanism 400 transfers articles 2 along an arcuate guide 14 to a label application station 20 disposed opposite assembly 25. As will be discussed in greater detail below, carrier mechanism 400 operates to vary the separation between successive articles passing through guide 14 between a first separation proximate entrance end 22*a* to a second separation proximate station 20 that is dependent upon the separation between labels provided on an applicator drum 100 in label application assembly 25.

Application station 20 includes an arcuate guide 18 against which the articles are compressed by applicator drum 100 as labels are applied to the articles. Guide 18 includes a resilient friction surface to impart a rolling action to the articles as the articles pass through the label application station such that labels are wrapped around the articles.

Carrier mechanism 460 performs essentially the same operation as carrier mechanism 400 except that mechanism 460 operates to decelerate articles from a first predetermined separation that matches the separation of labels on applicator drum 100 to a second predetermined separation suitable for transport on conveyor 22. By doing so, this arrangement imparts greater stability to discharged articles by minimizing relative movement of the articles to the conveyor at the discharge end of track 16.

Labels are supplied to applicator drum 100 from a web supply 30 supplying a web 4 of labeling material. Typically, web 4 includes a pre-printed polymer material formed of a polymer such as polyethylene. Other materials, including polymers such as polypropylene and polystyrene (among others) may also be used, although polyethylene has the additional advantage in that it is significantly less expensive than other polymers. Polyethylene film tends to be more stretchable than other polymer films. However, due to the constant tension provided in web 4 by the unique design of label application assembly 25, the stretchability of this material does not adversely impact the quality of labels supplied by the assembly.

Web supply 30 includes a pair of supply rolls 32, 34 that supply web 4 to a measuring roller assembly 50. Only one of supply rolls 32, 34 is active at any time, and a conventional change-over mechanism (not shown) may be used to switch between the rolls with minimal down time.

Measuring roller assembly 50 operates as a linear feed rate sensor using a free-wheeling roller 52 coupled to a rotational position sensor 54. Roller 52 has a known diameter such that the linear velocity of the outer surface thereof, and thus the linear feed rate of the web, may be calculated directly from the rotational speed of the roller. Sensor 54 may be any known rotational position sensor, e.g., an optical encoder.

Web 4 proceeds from assembly 50 to a web tracking control assembly 60 that is utilized to maintain lateral alignment of the web in assembly 25. Web 4 then proceeds to a registration sensor station 70 that detects the position of registration marks disposed on the web. Station 70 includes a roller 72 and a registration sensor 74 disposed opposite roller 72 at a lateral position relative to the web to detect registration marks disposed thereon. Registration sensor 74 may be positioned at practically any point between web supply 30 and applicator drum 100 in the alternative.

It should be appreciated that registration marks may take any number of forms, whether printed or otherwise formed in web 4. Printed registration marks may be disposed outside of a visible area on the labels, or may be integrated within the design printed on a label. Moreover, registration marks may be disposed at a cutting position for a label, or may be separated therefrom by a predetermined distance. Other registration mark designs may be utilized in the alternative.

From registration station 70, web 4 proceeds to the surface of applicator drum 100, where an attraction mechanism disposed on the outer surface of the drum applies a controlled tension to the web. Moreover, a pair of movable cutter assemblies 130, 170 disposed on drum 100 operate to sever labels from web 4 as each assembly 130, 170 passes a fixed knife 82 in a cutting station 80. As will be discussed in greater detail below, the rate at which web 4 is supplied via web supply 30 is controlled relative to the rotation of applicator drum 100 (which is driven by a main drive motor 85) such that a predetermined length of the web is disposed forward of a cutter assembly 130, 170 as the assembly passes fixed knife 82, whereby individual labels are severed from web 4 in a controlled manner.

An adhesive station assembly 90 is disposed beyond cutting station 80 to apply adhesive to leading and trailing ends of each label using an application roller 92. As will be discussed in greater detail below, adhesive is applied to the leading edge of the label prior to severing the label from web 4, such that the tension within the web assists in maintaining the leading edge of the label on the outer surface of applicator drum 100 as adhesive is applied to the leading edge thereof.

After adhesive is applied to the leading and trailing edges of a label, the label is presented to an article 2 via rotation of applicator drum 100, whereby rotation of applicator drum 100 through label application station 20 wraps the label around the article as the article rolls against guide 18.

Label Application Assembly

Figure 2:
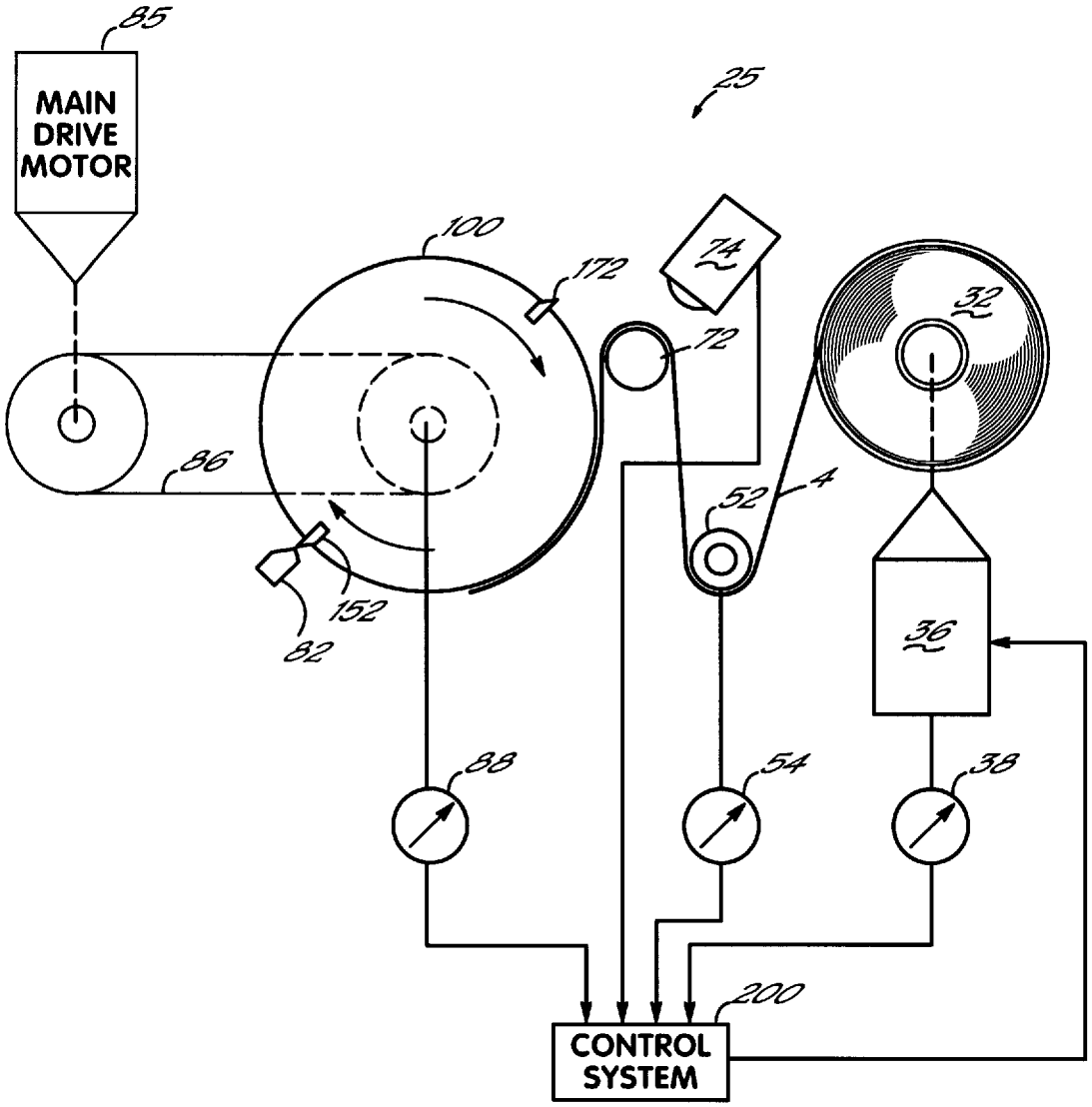
FIG. 2 is a block diagram of the primary components of the label application assembly of FIG. 1.

FIG. 2 illustrates the primary components involved in supplying and severing labels from web 4 in a controlled manner. Assembly 25 is under the control of a control system 200, which operates to control the supply rate of web 4 relative to the rotation of applicator drum 100. Applicator drum 100 is rotated via a main drive motor 85 coupled to the drum via a linkage diagrmmatically represented at 86. The rate of rotation of drum 100 is measured via a rotational position sensor 88, which may be any type of known rotational position sensor such as an optical encoder. Control system 200 also receives the output of sensor 54 to generate therefrom a measurement of the linear feed rate of web 4. Control system 200 also receives a registration signal from registration sensor 74.

In response to these inputs, control system 200 controls a drive motor 36 to control the rate of rotation of supply roll 32, and thus the feed rate of web 4. Drive motor 36 is typically a servomotor, and as such, additional input is provided to control system 200 via a rotational position sensor 38 (e.g., an optical encoder) which provides feedback from drive motor 36. It should be appreciated that a similar servomotor may also be used to drive supply roll 34 in a similar manner.

Assembly 25 is thus configured in a master-slave relationship, whereby the supply rate of web 4 is controlled relative to the speed of applicator drum 100. In the alternative, a reverse configuration may be provided wherein the rate of rotation of applicator drum 100 is controlled relative to the feed rate of web 4. In addition, it may be desirable in some applications to control both the feed rate of web 4 and the rotational rate of applicator drum 100. Therefore, the invention should not be limited to the configuration illustrated herein.

One embodiment of the invention utilizes a servomotor with a built-in encoder such as the FSM 460 servomotor from Centurion as the drive motor 36 and rotational position sensor 38, with an HR 625-500-x-BE1 Optical Encoder from Dynapar coupled to a 50.93 mm diameter measuring ruler used for rotational position sensor 54 and measuring roller 52, a Model NT-6 Optical Sensor available from Sick for registration sensor 74 and an HR-625-2500-x-BE1 Optical Encoder from Dynapar used for rotational position sensor 88. Rotational position sensor 54 may be geared with a ratio of 80/40 to measuring roller 52 to provide a resolution of 0.0393 mm/count or 25.5 counts/mm. It should be appreciated that these components are merely examples of a wide variety of other components that may be utilized in assembly 25 in the alternative.

Figure 3:
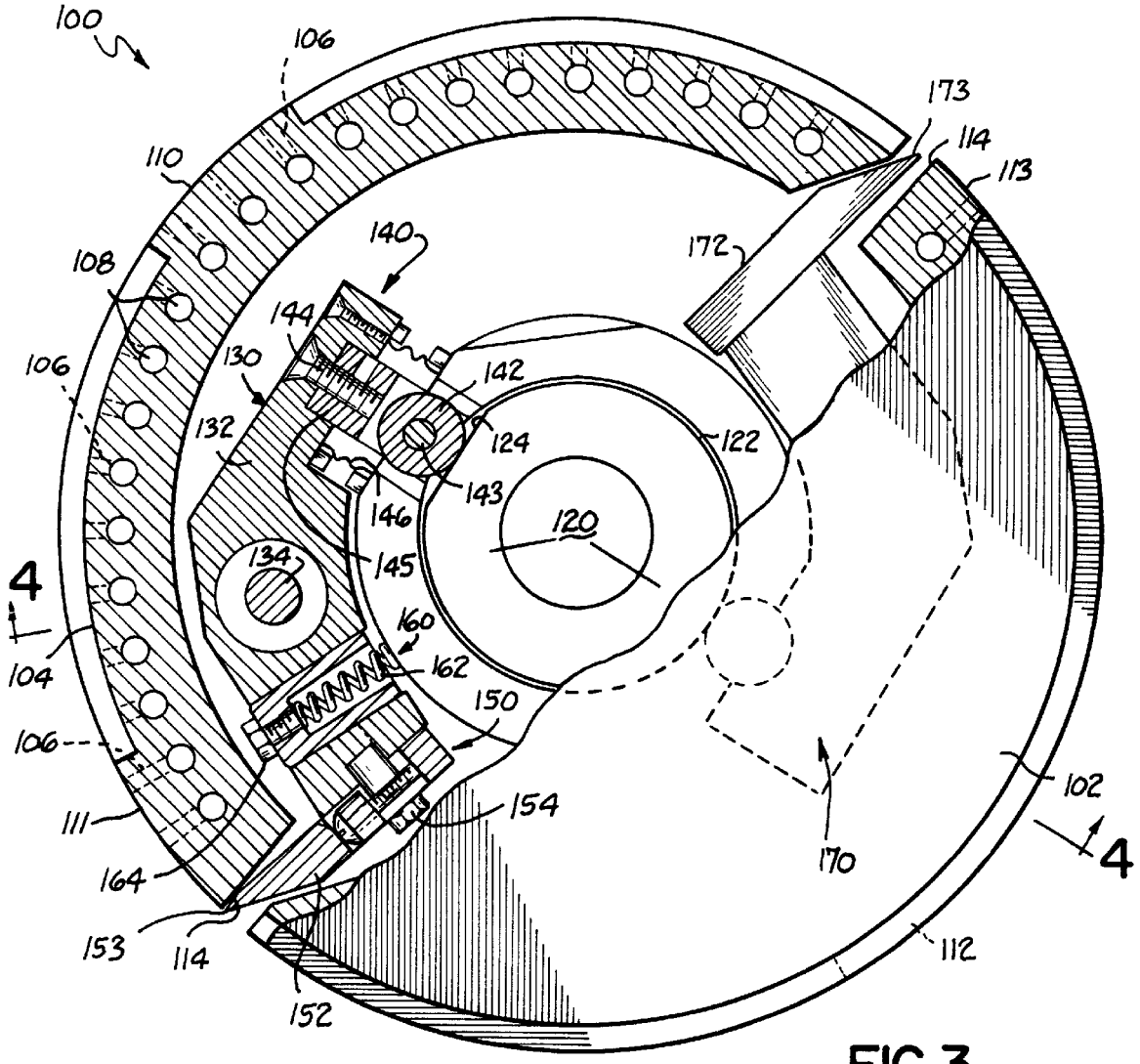
FIG. 3 is an enlarged top plan view of the label applicator drum of FIG. 1, with portions thereof cut away.
Figure 4:
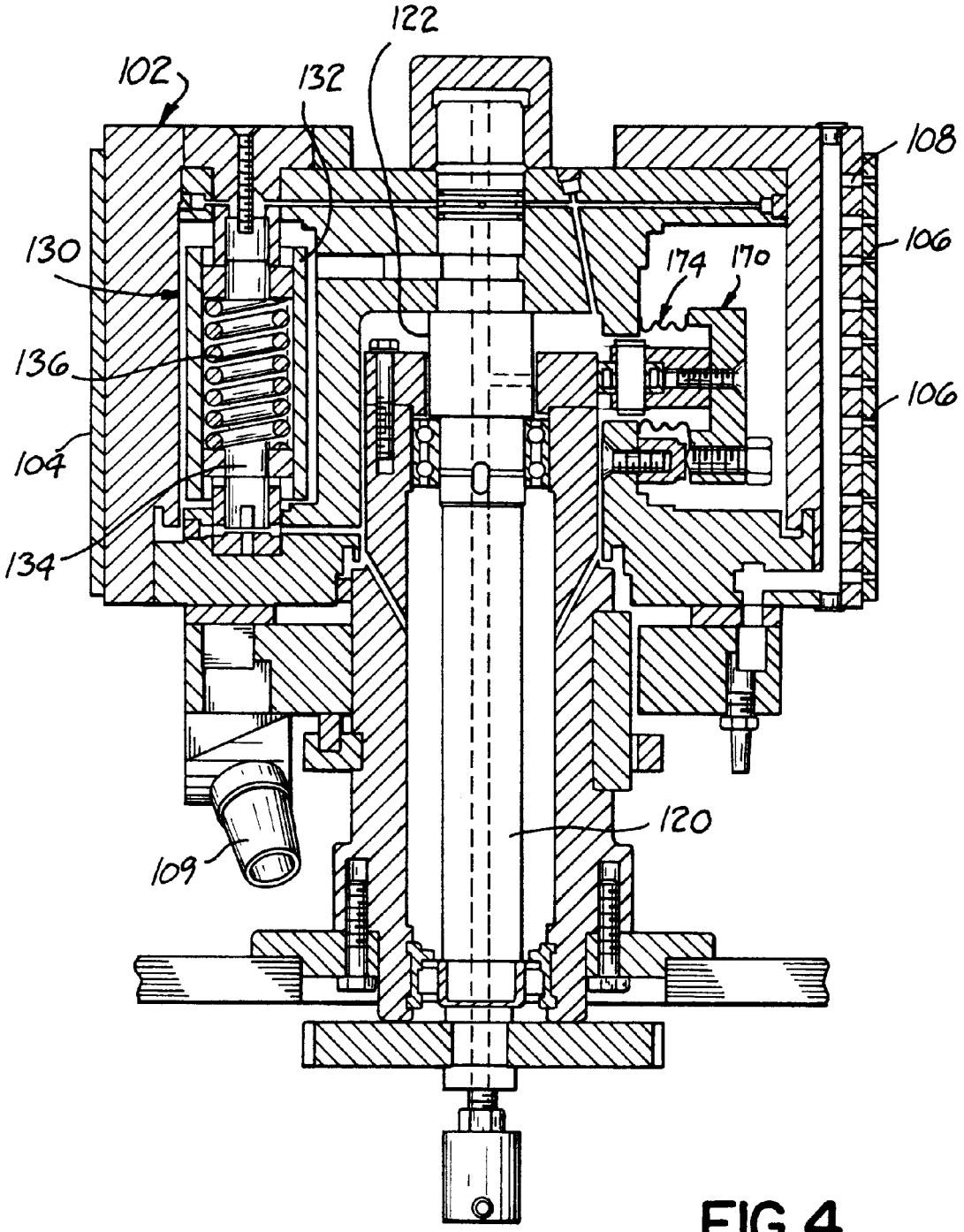
FIG. 4 is a side cross-sectional view of the label transfer drum of FIG. 3, taken along line 4—4.

FIGS. 3 and 4 illustrate applicator drum 100 in greater detail. Applicator drum 100 includes a rotatable drum body 102 configured to rotate about a fixed shaft 120. Rotatable body 102 includes an outer surface 104 having a plurality of vacuum ports 106 disposed thereon and supplied with a source of vacuum and/or positive pressure through a set of distribution channels 108 coupled to a vacuum port 109 (FIG. 4).

Two sets of raised pads 110, 111 and 112, 113 are disposed on outer surface 104 to receive leading and trailing edges of a label as the label passes an adhesive application station so that adhesive may be applied to the opposing edges of the labels. An applicator roller (not shown in FIGS. 3 and 4) is offset from outer surface 104 such a distance that label material supported on any pad 110–113 will be compressed against the roller, but material disposed between the pads will not. Thus, adhesive is applied only to the material supported on a pad.

As will become more apparent below, pads 110 and 111, and pads 112 and 113 are separated from one another around the circumference of drum 100 at a distance that is greater than the length of the labels so that the leading edge of each label may have adhesive applied thereto prior to severing the label from the web. This reduces the likelihood of a label sticking to the adhesive roller due to the additional tension provided by the unsevered web.

It is desirable for drum body 102 to be a changeable component such that different predetermined lengths of labels may be accommodated in apparatus 10. Different lengths of labels are accommodated by utilizing different relative spacing between pads 110 and 111, and between pads 112 and 113. It may also be desirable to enable leading pads 110, 112 to be removed from outer surface 104 and positioned at various points thereon to support different label lengths. The separation of pads 110 and 112, and of pads 112 and 113 will vary depending upon a number of factors, including the desired length of labels, as well as the relative positions of cutting station 80 and adhesive station assembly 90. Determination of the desired separation for any given combination of parameters is well within the ability of one of ordinary skill in the art.

As shown in FIG. 3, two sets of pads, pads 110 and 111, and pads 112 and 113, are provided around the circumference of rotatable body 102, each matched with a cutter mechanism 130, 170. It should be appreciated that any number of cutter mechanisms and associated raised pads may be disposed around the circumference of drum body 102 in the alternative.

As best shown in FIG. 3, cutter mechanism 130 (which is configured in a similar manner to cutter mechanism 170) includes a rocker body 132 pivotally mounted to pivot about a shaft 134 that extends parallel to shaft 120. A spring 136 (FIG. 4) is mounted concentrically with shaft 134 to compensate for temperature expansion in the bearing (not shown) through which the rocker body is pivotally mounted about shaft 134. As shown in FIG. 3, at one end of body 132 is disposed a cam follower assembly 140 including a roller 142 rotatably mounted about an axle 143. Axle 143 is secured via a bolt 144 to a follower body 145, and a flexible boot 146 seals the assembly. Cam follower assembly 174 of cutter mechanism 170 (FIG. 4) configured similarly to assembly 140.

Knife assembly 150 is disposed at the opposite end of rocker body 132 from cam follower assembly 140. A knife blade 152, having an edge 153, is secured to the end of rocker body 152 via a bolt or other securing mechanism 154. Edge 153 of knife blade 152 projects through an opening 114 in outer surface 104 of body 102, immediately following trailing pad 111 around the circumference of body 102.

A spring assembly 160 including a spring 162 extends perpendicular to shaft 120 and biases cutter assembly 130 toward an extended position, with knife blade 152 projecting through opening 114 beyond outer surface 104. A set screw 164 controls the tension of spring 162.

Roller 142 of cam follower assembly 140 rides along a cam 122 disposed on the outer surface of shaft 120. Cam 122 is circular in cross section with the exception of a recessed portion 124. Recessed portion 124 may have any number of profiles, e.g., a flattened profile as illustrated in FIG. 3. Recessed portion 124 is angularly oriented such that roller 142 engages the portion when knife blade 152 of knife assembly 150 is directly opposite fixed knife 82 of cutting station 80, thereby extending the knife blade at this position to shear a label from the web.

Figure 5A:
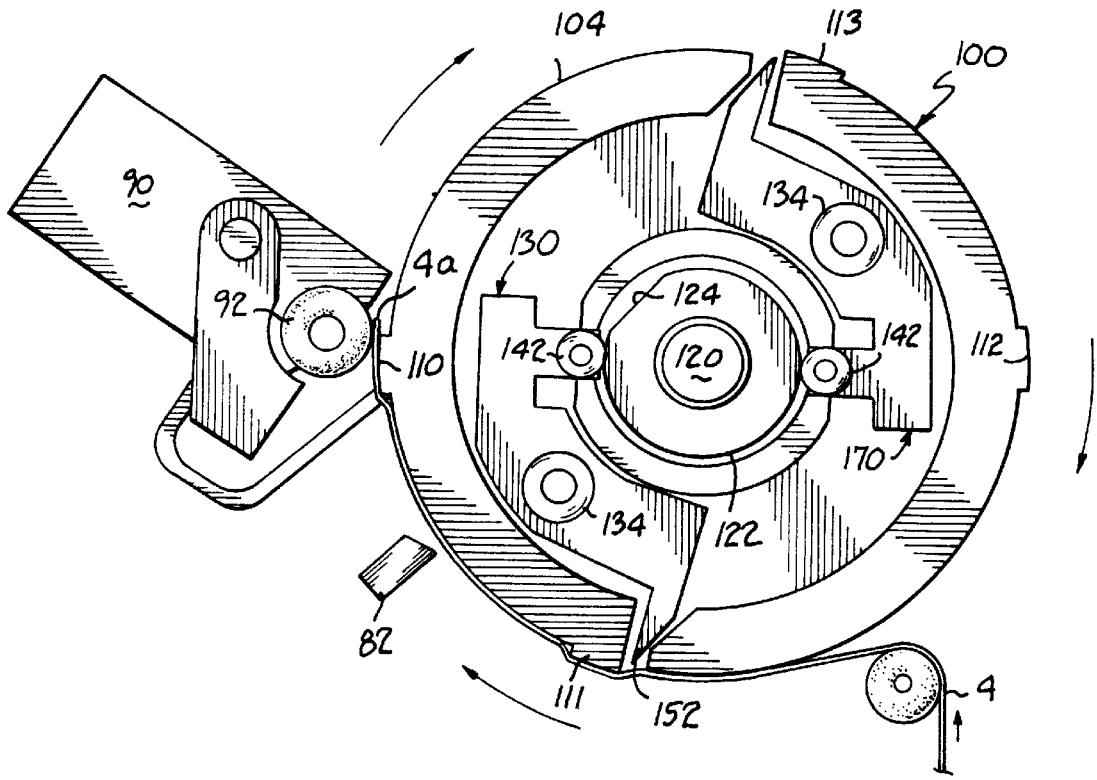
FIGS. 5A–5D are functional top plan views of the label transfer drum of FIG. 3 at different rotational positions thereof, illustrating the steps in cutting a label, applying adhesive thereto, and transferring the label to a container.

FIGS. 5A–5D illustrate the steps in severing a label from web 4 and applying the label to an article 2 presented at label application station 20. As shown in FIG. 5A, a leading edge 4*a* of web 4 is shown as fed forward of knife 152 of cutter mechanism 130 to a position where the leading edge slightly overlaps pad 110 when the pad is disposed opposite roller 92 of adhesive application assembly 90. When in this position, drum 100 rotates so that pad 110 sweeps under roller 92, sandwiching web 4 and applying adhesive 6 to the web proximate leading edge 4*a*. At this point, the label is still unsevered from the web, so the tension provided via the attraction mechanism generated by the vacuwn ports in outer surface 104 of drum 100 assists in attracting leading edge 4*a* to the outer surface of the drum, and thus away from adhesive roller 92. As such, this often eliminates the need for a blow off mechanism on the adhesive roller or the need for an increased level of vacuum proximate the leading edge as is required on many conventional designs.

As also shown in FIG. 5A, knife blade 152 of cutter mechanism 130 is retracted as roller 142 rides along the raised portion of cam 122 on shaft 120.

Figure 5B:
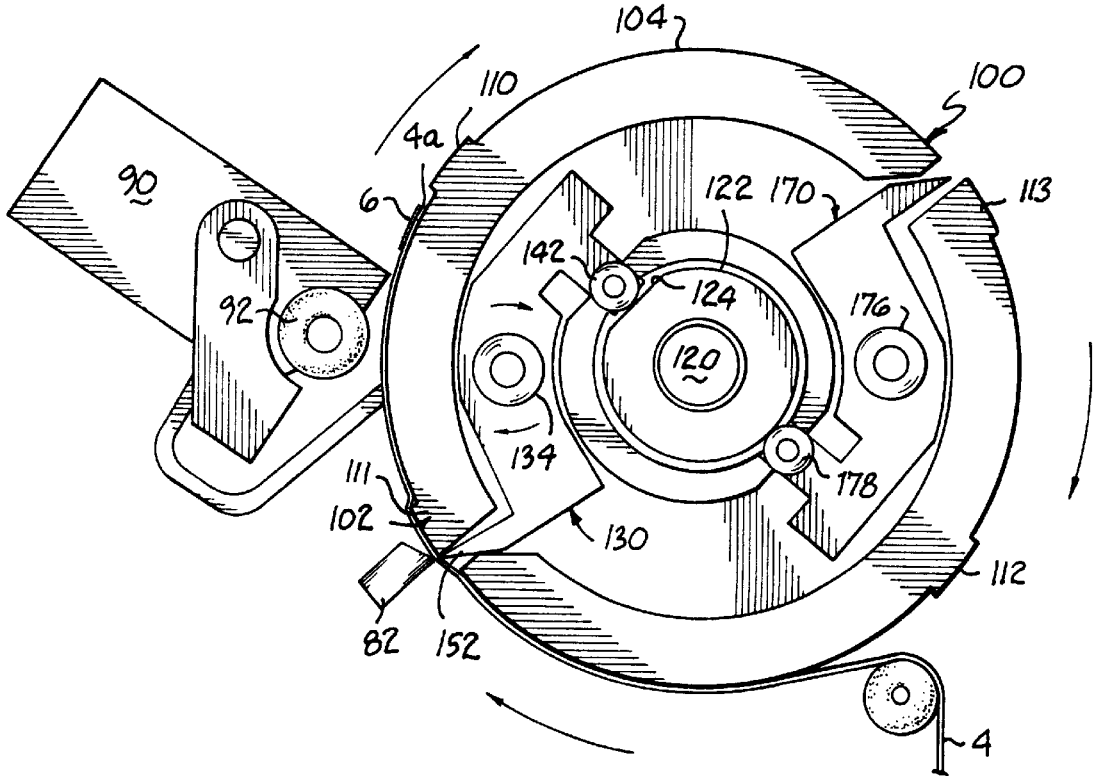

Next, as shown in FIG. 5B, drum 100 has rotated to the point at which knife blade 152 is directly opposite fixed knife 82. Web 4, which is fed at a slower rate than the rate of rotation of drum 100, has been fed to the desired label length such that the precise point at which the web is to be severed is located between knife blade 152 and fixed knife 82. With roller 142 of cutter mechanism 130 contacting the recessed portion 124 of cam 122, cutter mechanism 130 is pivoted about shaft 134 to extend knife blade 152, and thereby provide a shearing action with fixed knife 82 to sever a label 5 from web 4.

Figure 5C:
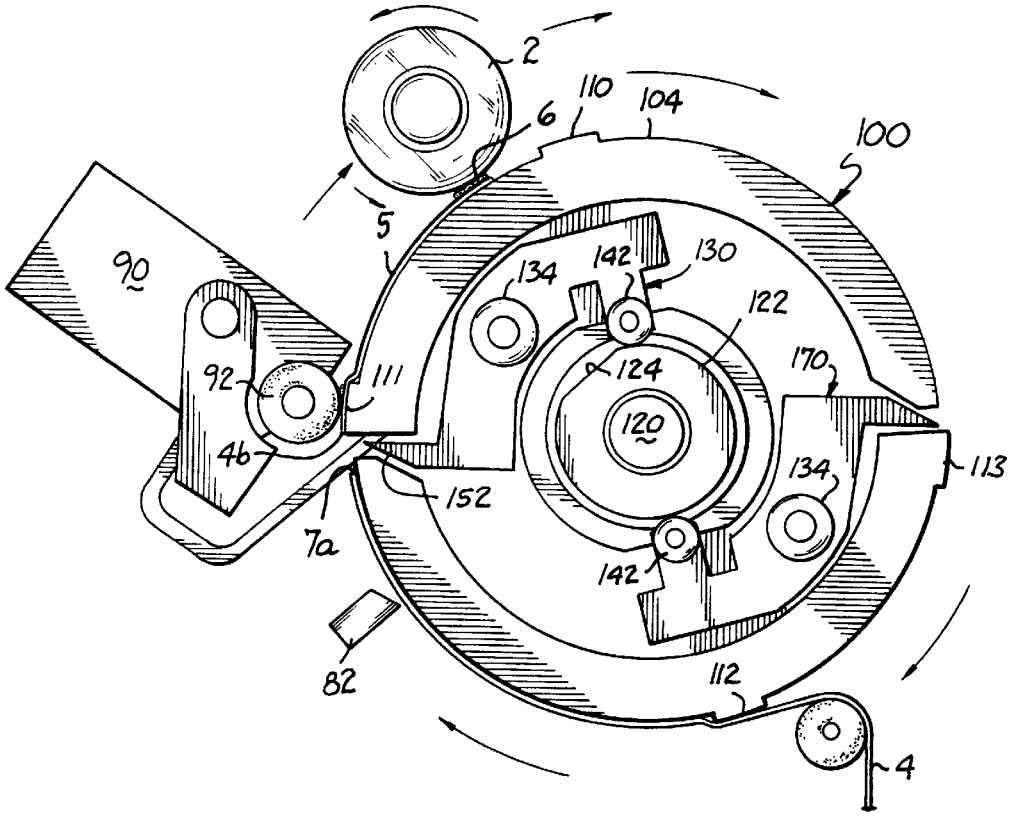

Next, as shown in FIG. 5C, upon further rotation of drum 100, pad 111 sweeps under adhesive roller 92 to apply adhesive 6 to the trailing edge 4*b* of label 5. In addition, at this time an article 2 is brought into contact with leading edge 4*a* of label 5 such that the adhesive thereon adheres to article 2. The label is pinched between article 2 and outer surface 104 and is rolled about its longitudinal axis to wrap label 5 around the article. As may also be seen from this figure, a new leading edge 7*a* is formed for web 4.

Figure 5D:
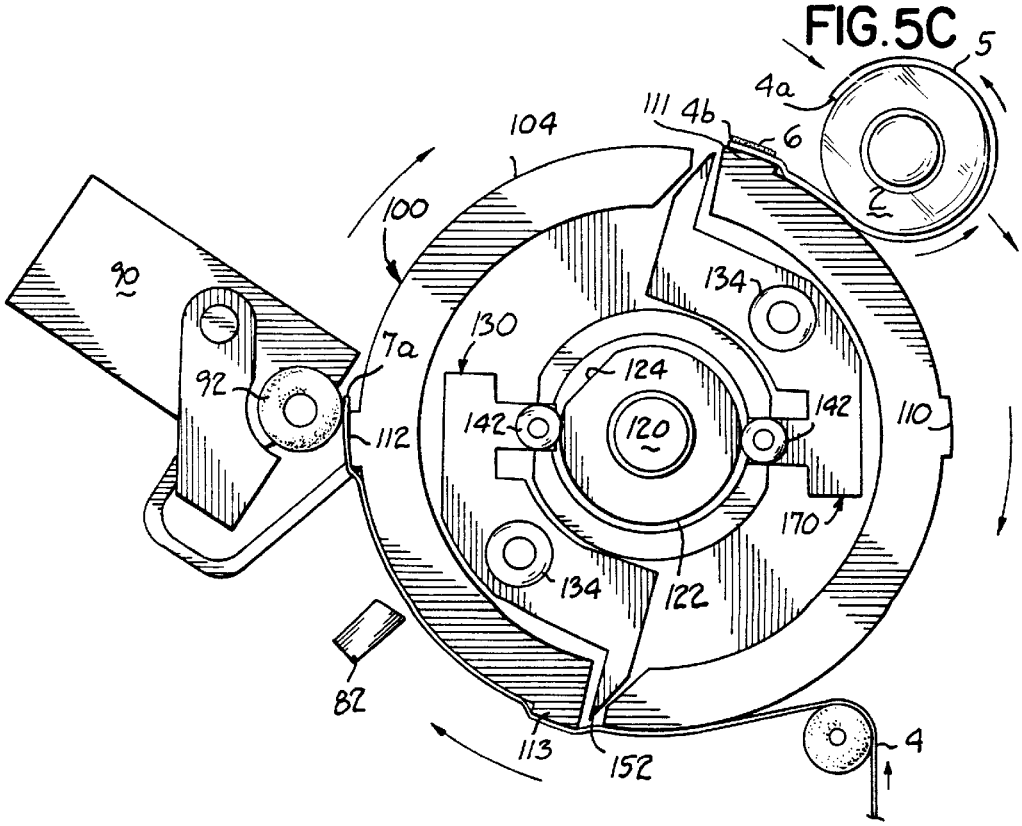

Next, as shown in FIG. 5D, label 5 has almost completely wrapped around article 2, and will continue to do so until the adhesive 6 proximate trailing edge 4*b* of label 5 contacts the article. In addition, the new leading edge 7*a* of web 4 is at approximately the same position as leading edge 4*a* was in FIG. 5A, immediately prior to application of adhesive by virtue of roller 92 sandwiching the web against a leading pad 112. Upon further rotation, cutter mechanism 170 will therefore sever another label from web 4, and the process will repeat. Thus, with this configuration, drum 100 processes two labels during each full rotation of the drum. With other numbers of matched cutter mechanisms and raised pads, different numbers of labels may be handled by drum 100 in the manner described herein.

Figure 6:
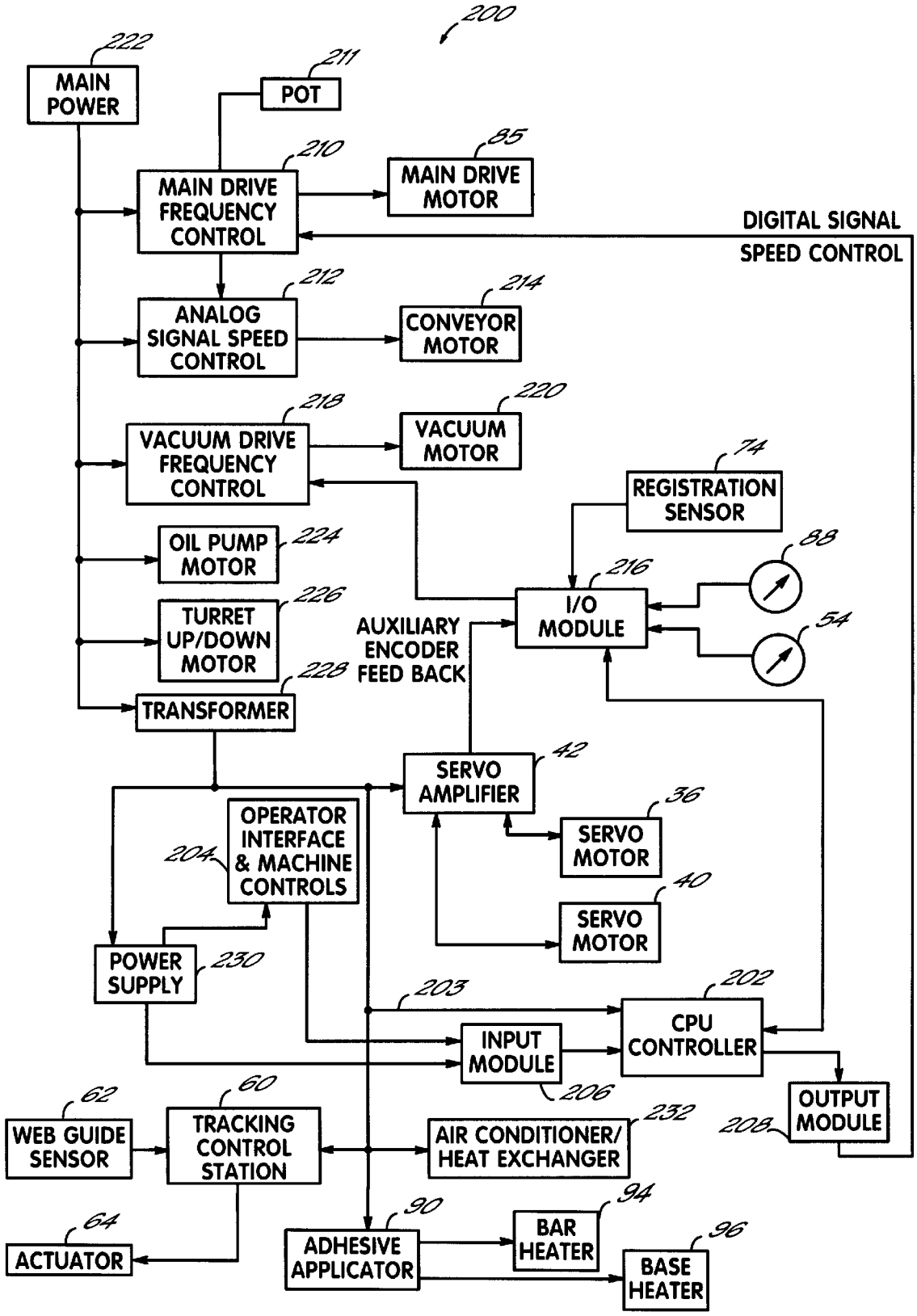
FIG. 6 is a block diagram of the control system for the labeling apparatus of FIG. 1.

Control system 200 is illustrated in greater detail in FIG. 6. The control system is primarily controlled via a CPU controller 202, which may be, for example, a CSM/CPU 502-03-853-03 digital processor from Gidding & Lewis, among others.

An operator interface and controls block 204 is shown interfaced with controller 202 through a discrete input module 206. Block 204 provides user interface for apparatus 10 with a operator, e.g., outputting status information to an operator through a video display and/or through various control panel indicators, as well as providing various operator controls, including "Start" and "Stop" buttons, "Jog" and "Auto" buttons, Label Feed "On" and "Off" Buttons and Adhesive "On" and "Off" buttons, among others.

Controller 202 provides output through a discrete output module 208 to generate a digital signal speed control to a main drive frequency control block 210 that controls the main drive motor 85 to operate in "fast" or "slow" modes. Block 210 receives a signal from a potentiometer 211 that controls the overall speed of the main drive, and is used by an operator to match the running speed of assembly 25 to the supply of articles. Moreover, block 210 outputs a control signal to analog speed signal control block 212 for controlling the speed of a conveyor motor 214 coupled to conveyor 22 (FIG. 1).

Controller 202 also interfaces with the various sensors utilized to provide web registration via an I/O module 216. Specifically, module 216 provides an interface between controller 202 and each of servo amplifier 42, encoders 54, 88 and registration sensor 74. Servo amplifier 42 is coupled to servo motor 36 and its associated encoder 38 (not shown in FIG. 6). Also shown is the servo amplifier's connection to a second servo motor 40 which drives a web supply roll 34 in a similar manner to servo motor 36. It should be appreciated that only one of motors 36, 40 is driven at a time based upon which supply roller is being run through assembly 25.

Module 216 also provides an interface with controller 202 to a vacuum drive frequency control block 218 that drives a vacuum motor 220. It is through this arrangement that the level of vacuum (or attraction) supplied to the outer surface of applicator drum 100 is controlled.

Blocks 210, 212 and 218 are all coupled to a main power source 222. Power is also supplied via block 222 to an oil pump motor 224, a turret up/down motor 226 (if so equipped) and a transformer 228. Transformer 228 provides the power signals for a bus 203 coupled between controller 202, servo amplifier 42, a power supply 230, web tracking control station 60, adhesive applicator 90 and an air conditioner/heat exchanger block 232. Power supply 230 provides power to operator interface and machine controls block 204 and input module 206. Web tracking control station 60 receives input from a web guide sensor 62 and outputs control signals to an actuator 64 to provide lateral alignment of the web, in a manner generally understood in the art. Adhesive applicator 90 provides control signals to a bar heater 94 and base heater 96, which respectively heat applicator roller 92 and a tank in applicator 90. These latter components are used in a number of conventional labeling apparatus designs, and will not be discussed in greater detail herein.

Figure 7:
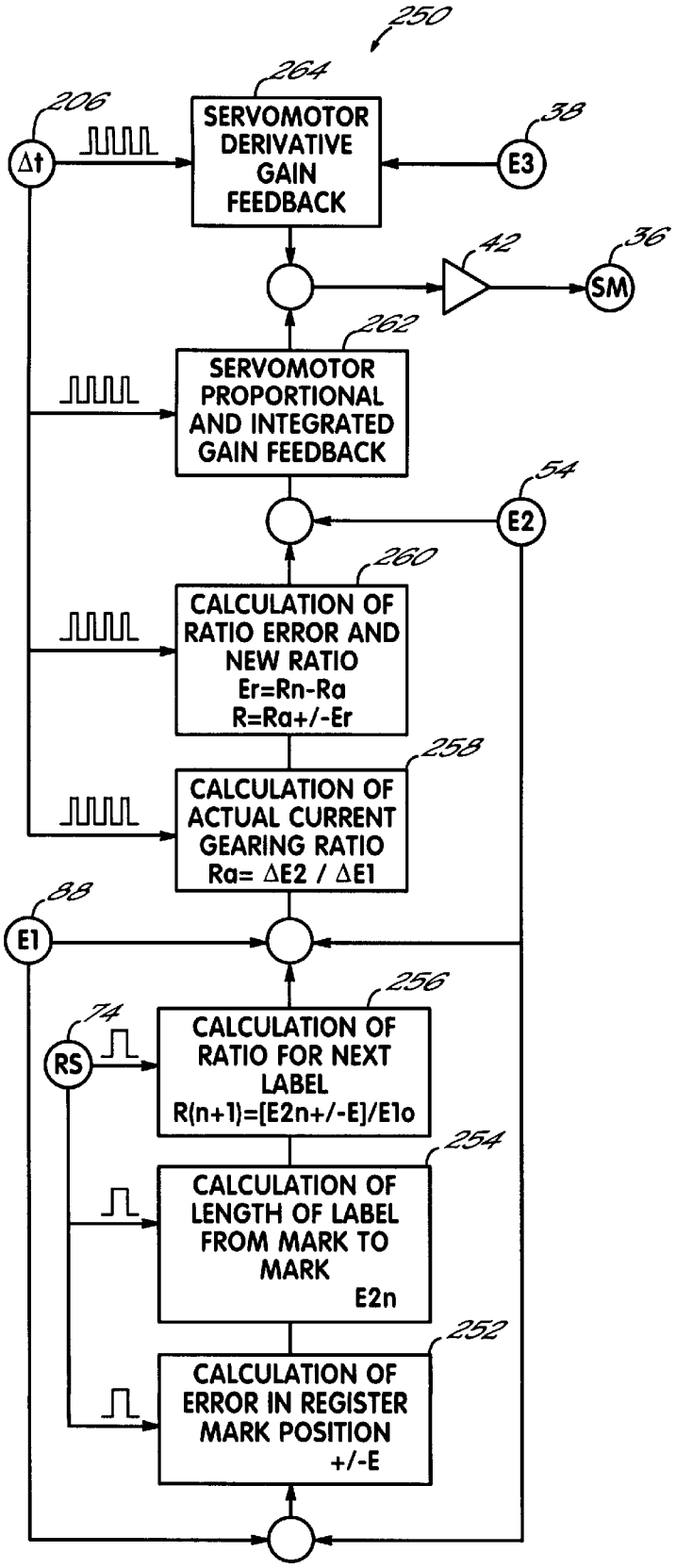
FIG. 7 is a flowchart illustrating a dynamic web registration process for the labeling apparatus of FIG. 1.

FIG. 7 illustrates a closed loop control algorithm 250 utilized in controller 202 to control servo motor 36 to provide web registration consistent with the invention.

Algorithm 250 utilizes a plurality of computational blocks 252, 254, 256, 258, 260, 262 and 264 to drive a control signal to servo amplifier 42 to operate servo motor 36. Blocks 252–256 are clocked by the leading edge of the output of registration sensor 74, while blocks 258, 260, 262 and 264 are clocked by a clock signal represented at 266, e.g., a 2 kHz clock signal.

Control algorithm 250 attempts to maintain a ratio of pulses between drum positioning encoder 88 and linear feed rate encoder 54 (designated E1 and E2) according to the equation:

$$R_0 = L_0(\pi D(E2_0/E1_0))$$

where $R_0$ is the nominal ratio, $L_0$ is the nominal label length, D is the diameter of free wheeling roller 52, and $E1_0$ and $E2_0$ are the total numbers of pulses, respectively, for full revolutions of encoders 88 and 54.

For each label n, block 252 receives the pulse train outputs (designated E1 and E2) of drum positioning encoder 88 and linear feed rate encoder 54 to generate a registration error signal E that is the difference, expressed in pulses, between the position of the registration mark on the label sensed by the registration sensor 74 and the preset (or expected) position of the mark.

Block 254 calculates the length of a label n from registration mark to registration mark in pulses of the linear feed rate encoder 54 (designated $E2_n$). This information is utilized in block 256 to calculate a ratio between encoders 88 and 54 for the next label (n+1) that is corrected for the registration error E, using the equation:

$$R_{(n+1)}=(E2_n \pm E)/E1_0$$

Block 258 calculates the actual ratio $R_a$ of the number of pulses of each of encoders 88 and 54 between time marks using the actual pulse trains from encoders 88 and 54, i.e.:

$$R_a=\Delta E2/\Delta E1$$

Block 250 calculates a ratio error $E_r$, that is the difference between the current ratio $R_n$ (i.e. $E2_n/E1_0$), and the actual ratio $R_a$, using the equation:

$$E_r=R_n-R_a$$

In addition, a command for the servo motor such to achieve the actual ratio in the next time interval is calculated, using the equation:

$$R=R_a \pm E_r$$

Next, block 62 generates from the command from block 260 the proportional and integrated feedback signals for controlling servo motor 36. This information is summed with the derivative gain feedback generated by block 264 based upon the feedback signal from servo motor encoder 38 (designated E3). It should be appreciated that simultaneous use of integrated, derivative and proportional feedback signals is well known in the art. Moreover, it should be appreciated that other control algorithms which utilize the aforementioned equations may also be used in the alternative.

Figure 8:
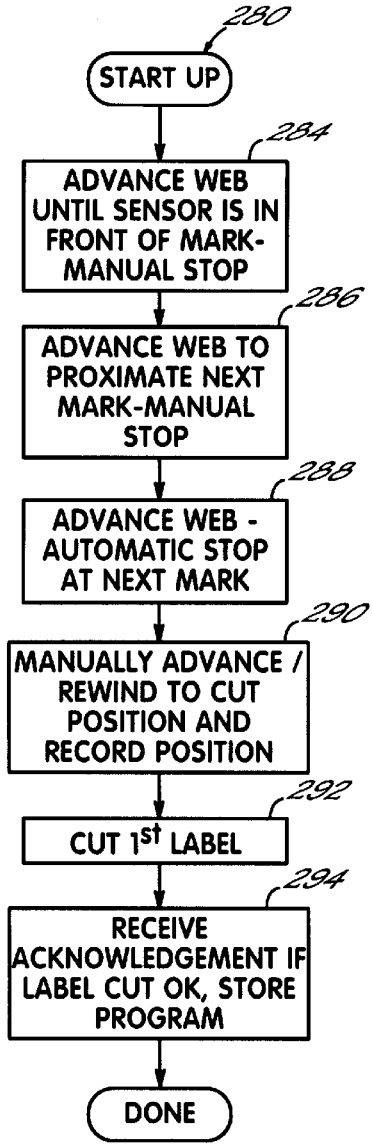
FIG. 8 is a flowchart illustrating the steps of a startup process for the labeling apparatus of FIG. 1.

A self-teaching start-up routine 280, executed by controller 202 of control system 200 to initialize apparatus 10, is illustrated in greater detail in FIG. 8. Routine 280 configures apparatus 10 to operate with a new roll of web material using a self-teaching process that often eliminates the requirement in many applications for the label length to be manually input by an operator. Routine 280 is executed by an operator after the operator installs a new web roll and feeds the leading edge of the web into assembly 25. The routine begins in block 284 by advancing the web (e.g., in response to user input received from an operator through controls 204) through assembly 25 until the registration sensor is in front of the first registration mark on web. At this time, the operator hits a "Stop" button to manually halt the apparatus. Next, in block 286, the web is advanced (e.g., in response to user input such as an operator depressing a "Start" or "Jog" button) until the registration sensor is proximate the next mark on the web. Then, the operator again hits the "Stop" button to halt the apparatus. During blocks 284 and 286, the output of the registration sensor and linear feed rate encoder are monitored to determine the number of pulses between the marks, and thus, the nominal length of the label ($L_0$) in terms of the output of the linear feed rate encoder.

Next, in block 288, the web is advanced in response to user input from an operator; however, in this block, the controller automatically advances the web and attempts to stop the web precisely at the next registration mark without any additional operator intervention. At this time, the operator may also be requested to indicate to the system whether the automatic advance successfully terminated directly at the next registration mark.

Assuming that this operation was successful, in block 290 the controller receives user input from an operator to manually rewind and/or advance the web to the desired cut position for the label (e.g., in response to an operator depressing suitable "Rewind" and "Advance" buttons). Next, the operator depresses a button or otherwise indicates to the controller that the cut position has been set During the manual rewind/advance, the controller monitors the linear feed rate encoder output to set the cut position in units of the linear feed rate encoder pulses relative to the registration mark.

Next, in block 292, the controller attempts to operate the apparatus to cut the first label based upon the registration information calculated above for the web, e.g., in response to suitable user input from an operator. The controller halts the apparatus after the first label is cut, and in block 294, waits to receive acknowledgment from the operator that the label cut was acceptable. If not successful, a process similar to block 284–292 may be repeated, or the routine may terminate with a failure indicated. However, if successful, the controller stores the program in one of a plurality of program storage locations. After the program is stored, the apparatus is then ready to begin processing articles using the aforementioned closed loop control algorithm when suitable user input is received from an operator.

Figure 9:
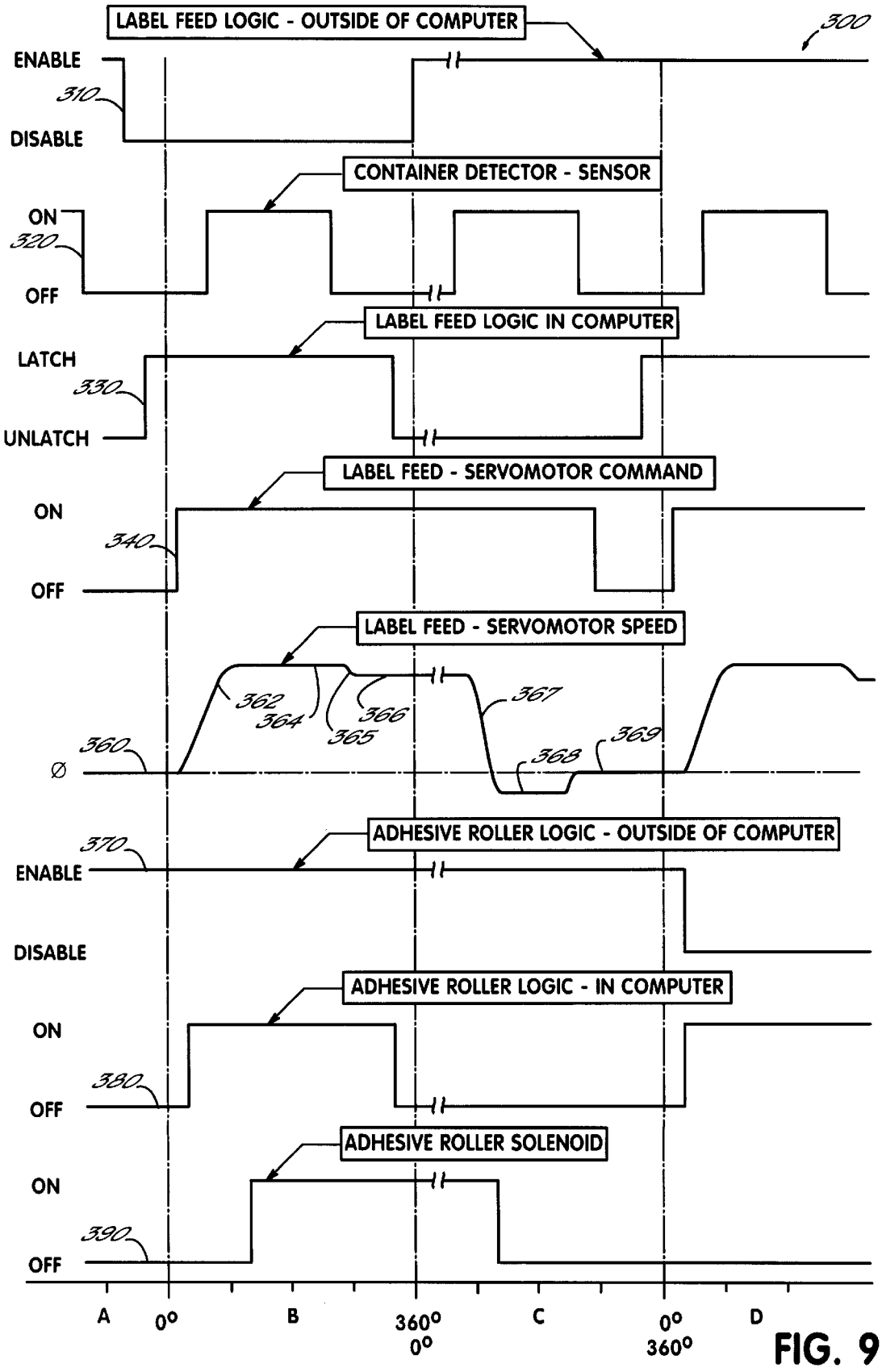
FIG. 9 is a timing diagram illustrating the timing of operations in the labeling apparatus of FIG. 1.

The sequence of logic signals in apparatus 10 is illustrated at 300 in FIG. 9, where each signal, timed according to the rotational position of the drum (i.e., from 0 to 360 degrees, with each complete rotation, or cycle, being designated A–D). A container detector signal 320 is shown being latched to "on" upon receipt of a each container into apparatus 10.

For example, during initiation of a label feed operation during a cycle A, a label feed logic signal 310 may be enabled, typically in response to an operator depressing an label feed "On" button on the apparatus, or in response to a signal provided by an external device such as a sensor that detects when one or more containers or articles are about to be received in the apparatus for labeling. Upon container detector signal 320 being latched to "on", an internal label feed logic latch signal 330 then latches prior to the start of cycle B, so that it is effectively delayed one cycle from the label feed logic signal. Then, after the knife has passed the cutting position (the 0 degree position) at the start of cycle B, a servomotor command signal 330 is asserted to start drive motor 36. The speed profile of drive motor 36 is illustrated at 360, including a minimal possible acceleration phase 362 that is encountered from about 15 to about 115 degrees, a minimal overspeed necessary phase 364 from about 115 to about 270 degrees, a deceleration to nominal speed phase 365 from about 270 to about 285 degrees and a nominal speed phase 366 thereafter that is related to a machine speed of $V_n$=CPM (containers per minute)×L (label length).

FIG. 9 also illustrates a adhesive roller logic signal 370 that is initially illustrated as enabled to reflect that adhesive should be applied to any labels processed by apparatus 10. If adhesive application is enabled, immediately after the servomotor command signal 340 is asserted, an adhesive roller logic signal 380 is applied, and an adhesive roller solenoid (represented by signal 390) is asserted about 90 degrees delayed relative to signal 380 (so that adhesive may be applied to the last label whenever a labeling is stopped, as described below).

Assuming now, for example, that label feed logic signal 310 is disabled during cycle A. With the label feed logic signal 330 delayed one cycle relative to signal 310, signal 330 is not unlatched until just prior to the completion of cycle B. Then in cycle C, the speed profile 360 of drive motor 36 is altered to perform a stop down, including a minimal deceleration phase 367 from about 90 degrees to about 120 degrees and a rewind phase 368 that serves to withdraw the web a predetermined distance (e.g., about 2–3 mm behind the knife blade) and thus maintain the web in a ready state just beyond the still-rotating drum. After a rewind, the servomotor command signal 340 is shut off, and the drive motor speed goes to null in phase 369.

Also during cycle B, once label feel logic signal 330 is unlatched, adhesive roller logic signal 380 is unlatched to inhibit adhesive application, resulting in (after a delay of about 120 degrees to permit adhesive to be applied to the last label) the adhesive roller solenoid signal 390 being deasserted.

FIG. 9 additionally illustrates a restart of label application in cycle D, upon label feed logic signal 310 being enabled during cycle C. In this instance, label feed logic signal 330 is asserted just prior to the start of cycle D, and servomotor command signal 340 is applied to start drive motor 36 and cause the drive motor to follow the speed profile illustrated at 360. However, in this cycle, the adhesive roller logic signal 370 has been disabled, so regardless of whether the internal roller logic signal 380 being set to "on", solenoid signal 390 is not asserted, and no adhesive is applied to a label.

It should be appreciated that development of suitable control programs to implement the functionality described herein, and in particular in connection with FIGS. 7–9, is well within the abilities of one of ordinary skill in the art. Therefore, no additional discussion thereof is provided herein.

Carrier Mechanisms

Figure 10A:
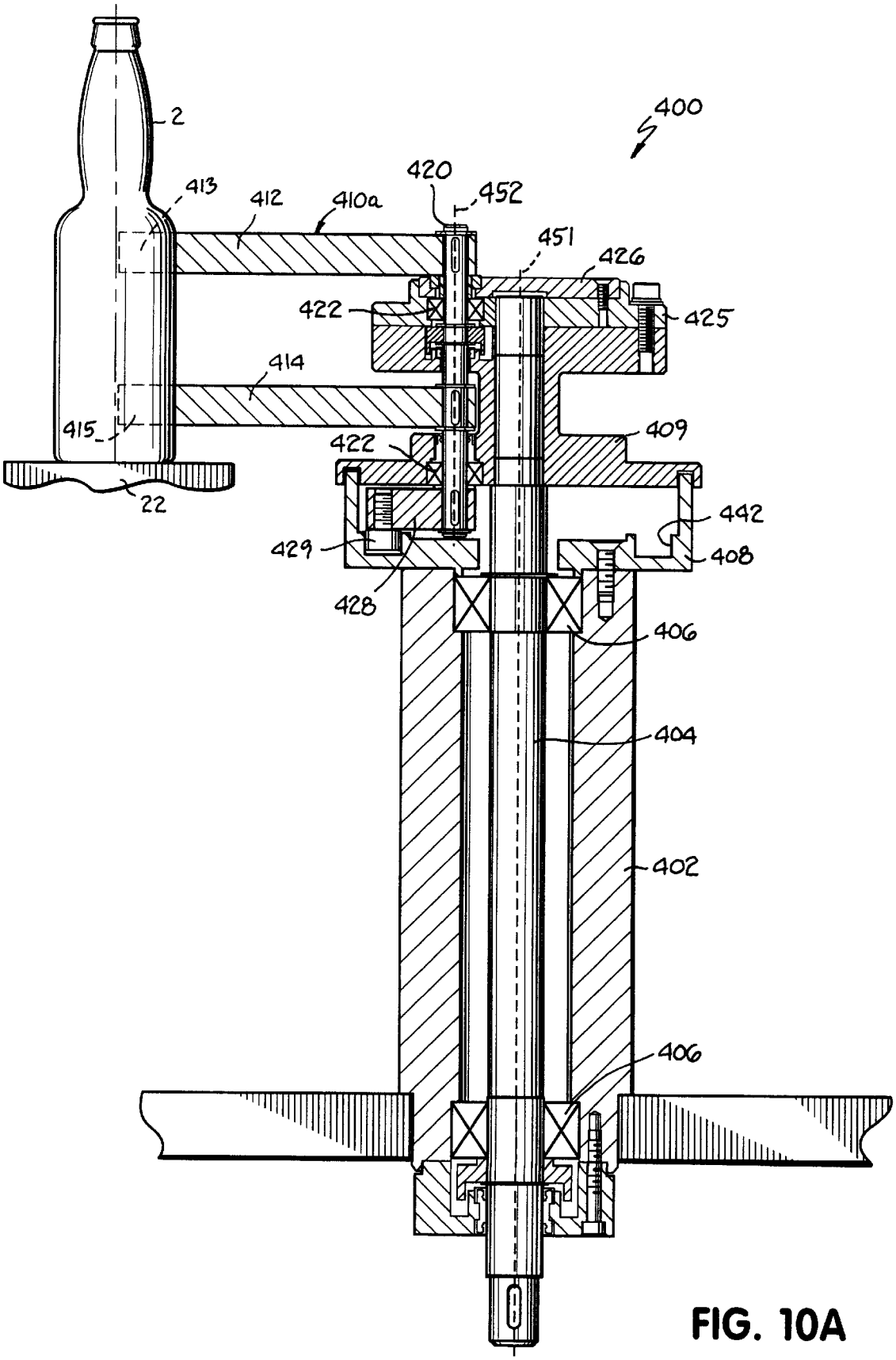
FIG. 10A is a side cross-sectional view of one of the carrier mechanisms of FIG. 1, with only one article carrier illustrated for simplicity.
Figure 10B:
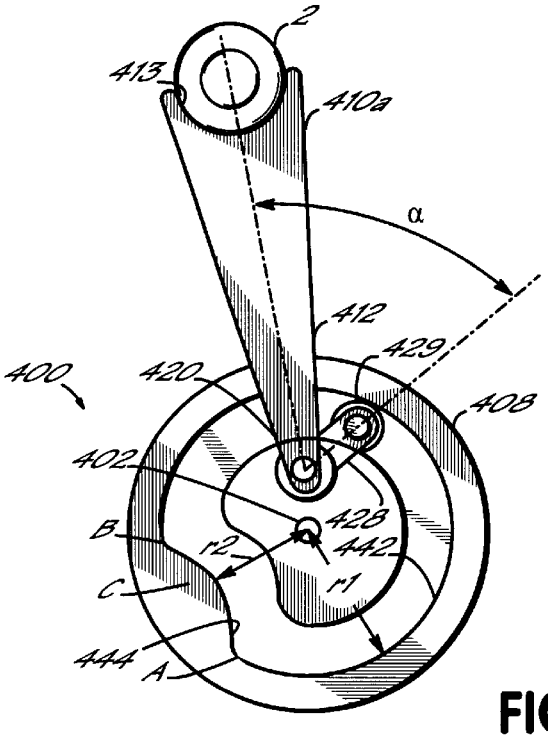
FIG. 10B is a functional top plan view of the carrier mechanism of FIG. 10A, with only one article carrier illustrated for simplicity, and with the hub thereof removed to facilitate viewing of the clamming mechanism utilized thereby.

FIGS. 10A and 10B illustrate carrier mechanism 400 in greater detail. It should be appreciated that carrier mechanism 460 may be similarly configured, albeit with a different cam profile suitable for its function, as will become more apparent below.

In general, each carrier mechanism is configured to sequentially transport articles such as a beverage containers along an article engaging surface of a guide and between first and second stations, while varying a predetermined transport parameter for the articles. In the embodiment described herein, the predetermined transport parameter is the pitch of the articles—that is, the separation between successive articles. The articles are carried by article carriers disposed at the ends of arms that are pivotably coupled to a central, rotating hub. A pitch varying mechanism utilized by each carrier mechanism relies on a clamming action to rotate the arms relative to the rotating hub, whereby the pitch between transported articles may be controlled principally through rotary motion to provide reliable high speed operation for high throughput machines.

The first and second pitches may each be dependent upon a number of factors, e.g., the linear and/or rotational velocity of articles, the size of the articles, etc. As such, the parameters of the surrounding stations that may need to be matched to provide controlled pitch with a carrier mechanism may not be cast in terms of separation, but may instead be based upon velocity or another parameter, as will become more apparent below. However, given that pitch, velocity, article size, etc. are interrelated with one another, it will be appreciated that a carrier mechanism consistent with the invention may alternatively be configured to control other parameters.

As shown in FIG. 10A, carrier mechanism 400 includes a shaft housing 402 having a drive shaft 404 rotatably mounted therein via bearings 406. A cam housing 408 is fixedly coupled to shaft housing 402, and a hub 409 is fixedly coupled to drive shaft 404 to cooperatively rotate therewith.

Figure 11A:
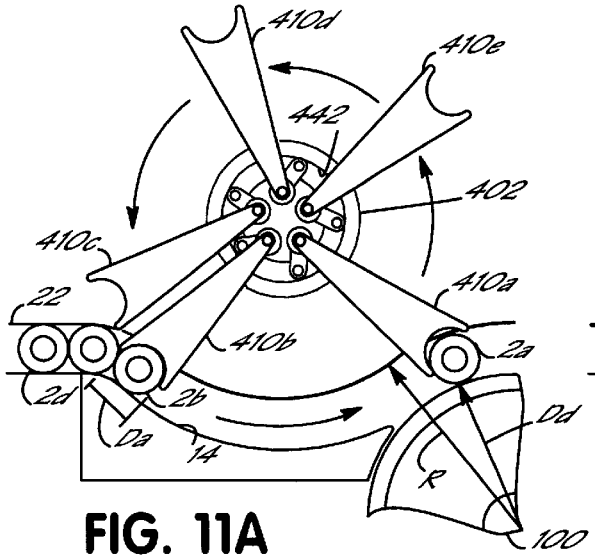
FIGS. 11A–11E are functional top plan views of the carrier mechanism of FIGS. 10A–10C at different rotational positions thereof, illustrating the transfer of articles from a conveyor to an applicator drum.

As shown in FIG. 11*a*, for example, a set of five article carriers 410*a*, 410*b*, 410*c*, 410*d* and 410*e* are evenly spaced around hub 409 in the illustrated embodiment. Only one such article carrier 410*a* is shown in FIGS. 10A and 10B to simplify the illustrations. However, it should be appreciated that any number of article carriers may be utilized on carrier mechanism 400 consistent with the invention.

Article carrier 410*a* includes upper and lower arms 412, 414 that respectively terminate with a gripping mechanism such as a pair of pockets 413, 415 integrally formed thereon for receiving an article 2 supported on conveyor 22. Pockets 413, 415 are sized and configured to circumscribe a cylindrical portion of article 2, and may utilize different profiles for other article configurations in the alternative. Moreover, other gripping mechanisms may be utilized as an alternative to pockets 413, 415 depending upon the type of article being transported. Moreover, in other embodiments, multiple axially-displaced pockets may not be required to reliably engage articles.

As best shown in FIG. 10A, arms 412, 414 are fixedly mounted on a rocker shaft 420 that is pivotably coupled to hub 409 through bearings 422. Rocker shaft 420 projects through apertures in a phaseable lid 425 and a seal lid 426 that overlap hub 409 and seal the inner components thereof.

A linkage member 428 is fixedly mounted at the lower end of rocker shaft 420, with a cam follower 429 disposed at a distal end thereof In the illustrated embodiment, cam follower 429 is configured as a roller that engages an inwardly-facing wall 442 in cam housing 408 that functions as a cam for carrier mechanism 400.

As best shown in FIG. 10B, cam follower 429 and linkage member 428 are circumferentially spaced about rocker shaft 420 from arms 412, 414 to form an acute angle $\alpha$ relative thereto. In the illustrated embodiment, $\alpha$ is approximately 60 degrees, although other angles may be used in the alternative.

Figure 10C:
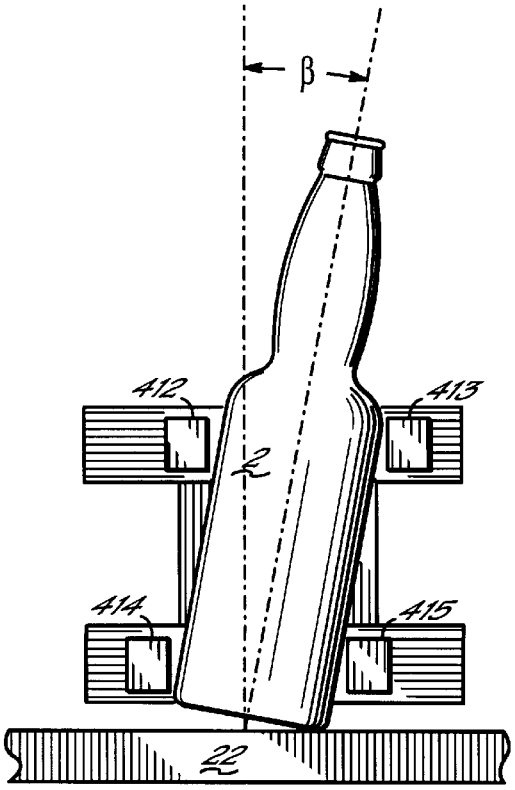
FIG. 10C is a functional side elevational view of the carrier mechanism of FIG. 10A.

In addition, as best shown in FIG. 10C, it may be desirable to provide an angular offset between arms 412, 414 about rocker shaft 420 so that arm 412 slightly leads or trails arm 414 and thereby induces a controlled tilt to an article 2 engaged by pockets 413, 415. By doing so, improved label alignment, and a reduced likelihood of label misalignnent, may result due to the ability to compensate for any imperfections in the containers and/or machined parts that might otherwise induce improper tilting of containers carried by the mechanism. In the illustrated embodiment, the angular offset is provided by manipulation of phaseable lid 425 (FIG. 10A), which is configured to be secured at different angular positions within a defined range to vary the angular offset between arms 412 and 414. Moreover, the angular offset of arms 412, 414 is typically set to impart a tilt to an article retained thereby to an angle $\beta$ offset from vertical of about +/−1 degree (the amount of tilt is exaggerated in FIG. 10C for illustrative purposes). Other degrees of tilt may be utilized in other embodiments, and may often be determined empirically based upon factors such as the type and configuration of the articles, among other factors.

Returning to FIG. 10A, hub 409 is considered to rotate about a first axis 451 defined along the longitudinal axis of drive shaft 404, while article carrier 410 is considered to pivot about a second axis 452 defined along the longitudinal axis of rocker shaft 420. In operation, therefore, as hub 409 rotates about first axis 451 in response to rotation of drive shaft 404, cam follower 429 rides along cam 442 to controllably pivot article carrier 410*a* about second axis 452. As a result, the angular velocity of article carrier 410*a* is controllably varied relative to the angular velocity of hub 409. It should be appreciated that a multitude of other known cam and linkage arrangements may be utilized in the alternative to impart a controlled angular offset of each article carrier relative to hub 409.

The profile of cam 442 is selected to provide a controlled pitch at first and second positions of carrier mechanism 400. For example, as shown in FIG. 11A, the first position is the position at which an article carrier (e.g., article carrier 410*b*) engages an article (e.g., article 2*b*) on conveyor 22. The second position is the position at which an article carrier (e.g., article carrier 410*a*) deposits an article (e.g., article 2*a*) against the outer surface of applicator drum 100. The pitch in this application is defined as the distance between center points of successive articles.

At the first position, the desired pitch is based upon the separation between articles supplied to apparatus 10 via conveyor 22. To assure a continual supply of articles, the articles are typically permitted to "queue up" on the conveyor in an abutting relationship. As such, the separation between articles is directly related to the size of each article. With each article being cylindrical in shape, the separation between articles is the sum of the radii of successive articles. In addition, assuming each article has the same radius, the separation may be expressed in terms of twice the radius of an article, which is equal to the diameter of the article, designated herein as $D_A$. Thus, the desired pitch at the first position, $S_1$, is therefore:

$$S_1=D_A.$$

At the second position, the desired pitch is equal to the separation between the leading edges of labels supplied on the outer surface of applicator drum 100.

Assuming an applicator drum that provides n labels evenly spaced about the drum's outer surface, the separation at the second position, $S_2$, would thus be equal to the circumference of the drum (which is equal to $\pi$ times the diameter of the drum, $D_D$) divided by the number of labels n, or:

$$S_2=(\pi\times D_D)/n$$

Thus, for an applicator drum that supplies two labels per rotation thereof, the desired pitch at the second position is:

$$S_2=\pi/2\times D_D.$$

To achieve the desired separations at the first and second positions, it may also be desirable to configure the cam profile based upon the desired angular velocity of the article carriers relative to the processing rate of apparatus 10. For example, at the first position, it is typically desirable to match the angular velocity of the article carriers with the speed of incoming articles supplied to carrier mechanism to prevent line vibration and its associated problems. Moreover, to achieve the desired separation at the second position, the angular velocity is typically related to the angular velocity of the applicator drum. It should be appreciated that calculation of the desired angular velocity profile for the article carriers based upon the desired separations is well within the abilities of one of ordinary skill in the art.

With carrier mechanism 400 utilizing five article carriers 410*a*–410*e*, and with applicator drum 100 applying two labels per rotation, the hub of carrier mechanism 400 is coupled to applicator drum 100 and drive motor 85 to provide a 1:2.5 gearing ratio between mechanism 400 and applicator drum 100, whereby applicator drum 100 rotates five times for every two rotations of mechanism 400.

Also, as shown in FIG. 10B, for example, the cam profile of cam 442 defines two regions segregated at points A and B. The first region, extending counter-clockwise from point A to point B, has a fixed radius $r_1$ that maintains a constant angular velocity for each article carrier having its associated cam follower 429 disposed therein. Coupled with the fixed gearing ratio between the carrier mechanism and the applicator drum, the desired pitch at the second position is assured.

In the second region extending counter-clockwise from point B to point A, however, an article carrier is controllably decelerated to reduce the pitch of an article carrier proximate the first position to match that of the incoming articles, then accelerated to return to the pitch of the article carrier to match that of the labels on the applicator drum. The point in which the cam profile switches from decelerating the article carrier to accelerating the article carrier is labeled as point C, and is typically disposed at an angular position that orients the article carrier at the first position (offset an angle $\alpha$ from cam follower 429). The cam profile therefore may decrease from point B to a minimum radius $r_2$ proximate point C, and then increase back to radius $r_1$, proximate point A.

Typically, the variations in the cam profile form smooth transitions to facilitate rapid movement of the cam followers along the cam. It should be appreciated that the design of a cam profile that meets the above constraints is well within the abilities of one of ordinary skill in the art, and may, if desired, be determined in whole or in part empirically. Moreover, any number of alternate profiles that provide the required pitches at the first and second positions may also be used consistent with the invention.

It should be appreciated that for carrier mechanism 460 (FIG. 1), which operates to transport articles from applicator drum to conveyor 22 at the discharge end 22*b* of labeling apparatus 10, an essentially complementary cam profile may be used, which transports articles from a first position that matches the separation of articles being discharged by applicator drum 100 (essentially the same separation as the second position for carrier mechanism 400) to a second position that matches the desired separation of articles discharged onto the conveyor (essentially the same separation as the first position for carrier mechanism 400). For carrier mechanism 460, it is desirable to return articles onto conveyor 22 at the same linear velocity as that of the conveyor to prevent any slippage or possible tilting of the articles as they are received onto the conveyor.

Returning to FIG. 1, it is important to note that in the illustrated embodiment, each article carrier is configured to transport an article along an article engaging surface defined by fixed guide 14, with the pocket disposed at the end of the article carrier merely operating to "push" the article along the guide. In many embodiments, for example, it may be desirable to abut or engage articles without actually gripping the articles (e.g., applying a compressive force to opposing sides of the articles or otherwise restraining the articles from motion in all directions). Instead, articles may effectively be trapped between the pockets and the guide so that the articles tend to "ride" along the guide under a motive force applied by the pockets—that is, the guide principally determines the path of travel for the articles, while the pockets simply accelerate and/or decelerate the articles as they travel along the guide. In different applications, it may be desirable to permit the articles to either roll or slide along the guide in a controlled manner (e.g., by selecting a material for the article engagement surface having appropriate frictional properties).

By cooperatively transporting the articles using the guide to determine the path of travel, the need for movable gripping mechanisms is often eliminated. As such, complexity may be reduced, often reducing cost and improving reliability. Moreover, higher speed operation is typically possible since the additional components, movement and coordination that would otherwise be required to ensure that articles are securely gripped and released at appropriate times would likely limit the overall maximum operational speed of a gripping-type article carrier.

Figure 11B:
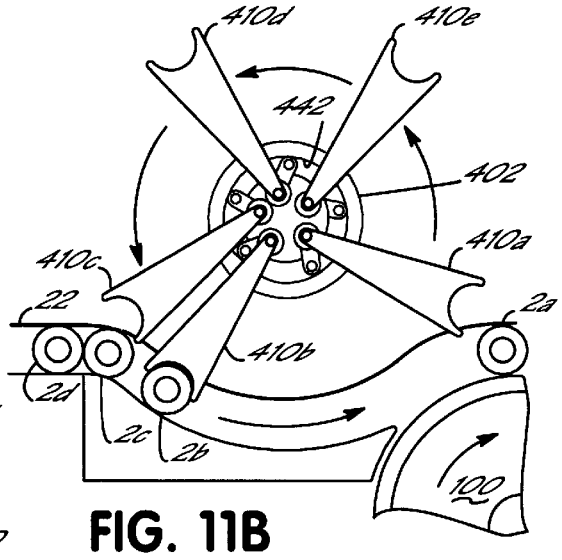
Figure 11C:
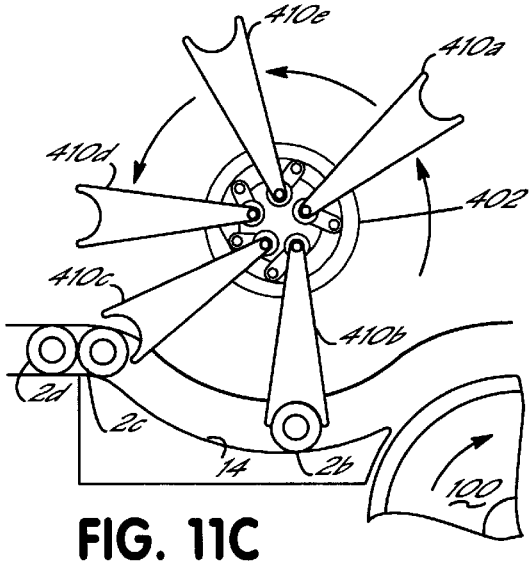
Figure 11D:
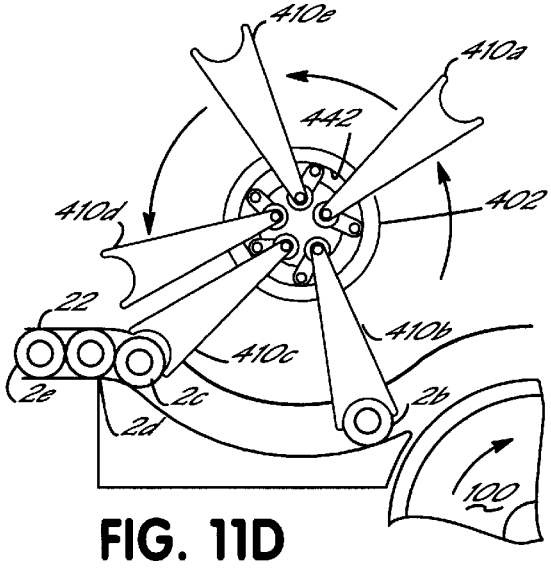
Figure 11E:
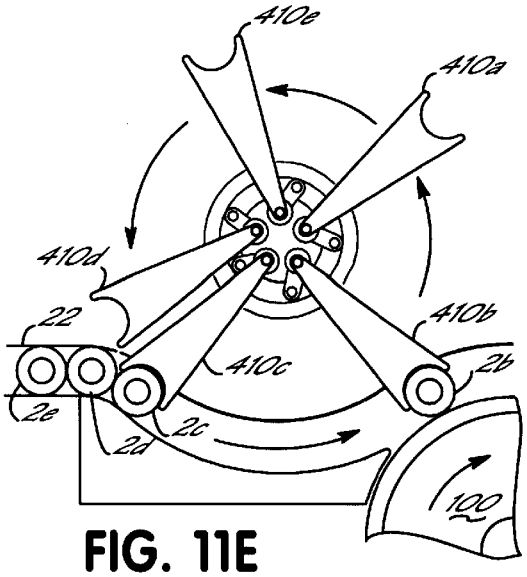

Returning to FIGS. 11A–11E, the sequence of transport for a plurality of articles 2*a*, 2*b*, 2*c*, 2*d*, and 2*e* is illustrated. As shown in FIG. 11A, article 2*a* is being discharged onto the surface of applicator drum 100 by article carrier 410*a*, with articles 2*b*, 2*c* and 2*d* queued up on conveyor 22 waiting to be transported to drum 100. Article carrier 410*b* has engaged article 2*b*, with article carrier 410*c* beginning to be decelerated via the cam profile to match the linear velocity thereof with that of article 2*c*. Next, as shown in FIGS. 11B, 11C and 11D, article carrier 410*b* is accelerated by the cam profile to increase the separation between article 2*b* and the following article 2*c*, while article carrier 410*c* continues to be decelerated to match the linear velocity with that of article 2*c*. Finally, in FIG. 11E, article carrier 410*b* has reached the second position, whereby the article carrier engages article 2*b* against a label disposed on the outer surface of applicator drum 100 with the desired pitch and in proper alignment with the label. Moreover, article carrier 410*c* engages article 2*c* in the first position in the same manner as described above for article carrier 410*b* and article 2*b* in FIG. 11A. Continued rotation of carrier mechanism 400 results in the same sequential controlled deceleration and acceleration of each article carrier 410*a*–410*e* so that articles are continuously transferred to applicator drum 100 with the requisite pitch therebetween.

It will be appreciated that carrier mechanism 460 operates in a complementary manner to transport articles from applicator drum 100 and back onto conveyor 22. Moreover, it should be appreciated that various modifications may be made to either of carrier mechanisms 400, 460 consistent with the invention.

Alternate Embodiments

Figure 12:
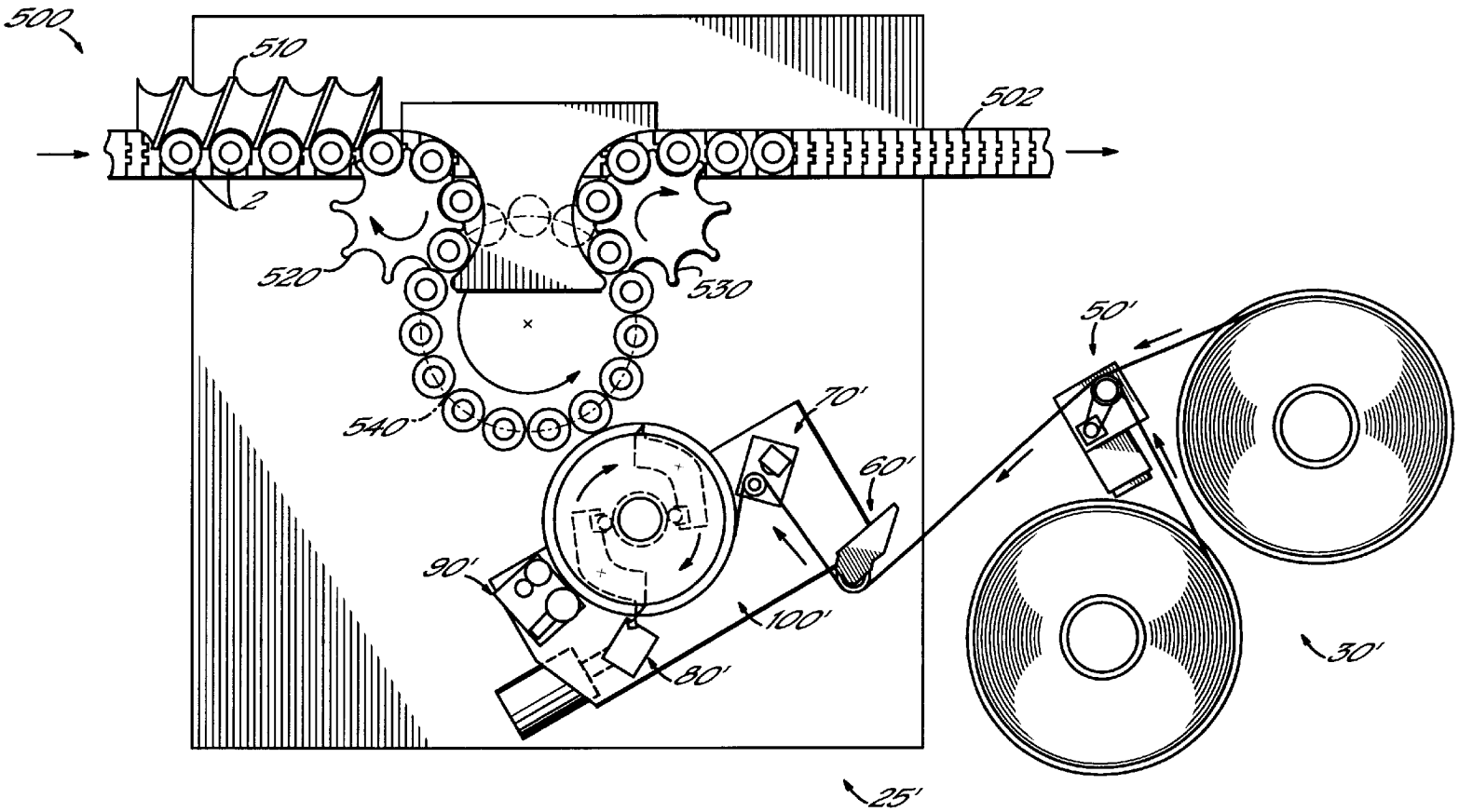
FIG. 12 is a top plan view of an alternate labeling apparatus to that shown in FIG. 1, utilizing a turret article transport mechanism.

It will be appreciated by one skilled in the art that the label application assemblies and carrier mechanisms described herein may be utilized independently of one another. For example, as shown in FIG. 12, a labeling apparatus 500 may include a label application assembly 25' which includes a web supply 30', measuring roller assembly 50', web tracking control assembly 60', registration sensor station 70', cutting station 80', adhesive station assembly 90' and applicator drum 100'. Each component in label application assembly 25' may be configured similarly to the corresponding unprimed components in label application assembly 25 of labeling apparatus 10 of FIG. 1, or may include any of the alternatives described above for any of such components.

Apparatus 500, however, includes an alternate article transport assembly to the arrangement of carrier mechanisms and conveyor for apparatus 10 of FIG. 1 Specifically, apparatus 500 includes a conveyor 502 that transports articles to and from apparatus 500. Articles 2 are received from conveyor 502 using a feed screw 510 that provides a controlled separation between articles. A first star wheel 520 transfers articles from feed screw 510 to a turret 540. Articles are then presented by turret 540 to drum 100' of assembly 25' for application of labels to the articles. Upon further rotation of turret 540, the articles are then transferred to a second star wheel 530, and then to conveyor 502 for transport out of apparatus 500.

It should be appreciated that the use and configuration of feed screws, star wheels and turrets are in general well known in the art. It should further be appreciated that other article transport assemblies may be used in the alternative, e.g., various other arrangements of feed screws, turrets and/or star wheels, among others.

It should further be appreciated that the carrier mechanisms described herein may be used independently of a labeling apparatus to transfer articles. In the packaging and/or bottling fields, for example, such mechanisms may be used to transport articles such as containers with a controlled pitch therebetween in various applications such as bottling machines, filling machines, cleaning machines, packing machines, etc. Moreover, in other fields, the carrier mechanisms may be used in other applications to provide controlled pitch between articles transported thereby. Also, as discussed above, the parameter controlled by a carrier mechanism consistent with the invention may be another transfer characteristic related to pitch such as velocity. This would permit, for example, a carrier mechanism to be used to transfer articles from a first station that outputs the articles at a first velocity to a second station that receives the articles at a second velocity, among other applications. Therefore, the invention should not be limited to any particular field or application of the carrier mechanisms described herein.

Various additional modifications may be made to the illustrated embodiments without departing from the spirit and scope of the invention. Therefore, the invention lies in the claims hereinafter appended.

What is claimed is:

1. An apparatus, comprising:

(a) a web supply configured to supply a web of material, the web of material including a sequence of unsevered labels;

(b) a rotatable drum configured to receive the web of material, the drum including an outer surface;

(c) an attraction mechanism disposed on the outer surface of the drum and configured to attract the web of material to the outer surface of the drum;

(d) a drive mechanism coupled to the drum and configured to rotate the drum and advance the outer surface thereof at a rate greater than a rate at which the web of material is advanced from the web supply;

(e) a cutter mechanism coupled to the drum and configured to sever a label from the web of material while at least a portion of the web of material engages the outer surface of the drum, the cutter mechanism including a retractable knife disposed on the drum and configured to rotate with the drum; and (f) an adhesive applicator positioned proximate the drum to apply an adhesive to at least a portion of the label while at least a portion of the label engages the outer surface of the drum.

2. The apparatus of claim 1, wherein the web supply includes a second drive mechanism configured to advance the web of material at a predetermined rate.

3. The apparatus of claim 2, wherein the web supply includes a supply roll, and wherein the second drive mechanism includes a servo motor directly coupled to the supply roll.

4. The apparatus of claim 2, wherein the second drive mechanism includes a rotational position sensor.

5. The apparatus of claim 4, wherein the rotational position sensor includes an optical encoder.

6. The apparatus of claim 2, further comprising a linear feed rate sensor disposed between the web supply and the drum, the linear feed rate sensor generating an output signal associated with a linear feed rate for the web of material.

7. The apparatus of claim 6, wherein the linear feed rate sensor includes a free wheeling roller having a fixed diameter and engaging the web of material between the web supply and the drum, and a rotational position sensor coupled to the free wheeling roller and outputting the output signal for the linear feed rate sensor.

8. The apparatus of claim 6, wherein the cutter mechanism severs the segment of the web of material when the drum is disposed at a predetermined rotational position, the apparatus further comprising a drum rotational position sensor coupled to the drum.

9. The apparatus of claim 8, wherein the rotational position sensor includes an optical encoder.

10. The apparatus of claim 8, further comprising a registration sensor, disposed between the drum and the web supply, the registration sensor configured to detect registration indicia located at predetermined positions on the web of material.

11. The apparatus of claim 10, further comprising a controller, coupled to the linear feed rate sensor, the drum rotational position sensor and the registration sensor, the controller configured to control at least one of the first and second drive mechanisms to coordinate rotation of the drum and supply of the web of material and thereby align the web of material relative to the cutter mechanism.

12. The apparatus of claim 11, wherein the controller is further configured to receive a length input associated with a desired length of the segment severed from the web of material.

13. The apparatus of claim 1, wherein the retractable knife is configured to sever the segment from the web of material at a predetermined rotational position of the drum.

14. The apparatus of claim 13, wherein the cutter mechanism further includes a knife retraction mechanism, coupled to the retractable knife and configured to selectively retract the knife within the outer surface of the drum.

15. The apparatus of claim 14, wherein the knife retraction mechanism includes:

(a) a fixed cam disposed about a rotational shaft of the drum; and (b) a rocker assembly mounted to the drum and configured to pivot about a pivot axis parallel to a rotational axis of the drum, the rocker assembly including the retractable knife at a first end thereof and a cam follower at a second end thereof that follows the fixed cam as the drum rotates about the rotational shaft, wherein the retractable knife is selectively extended and retracted through rotation of the drum about the rotational shaft.

16. The apparatus of claim 15, further comprising a stationary knife disposed at the predetermined rotational position of the drum, where the retractable and stationary knives selectively engage one another during rotation of the drum and thereby sever the segment at the predetermined rotational position of the drum.

17. The apparatus of claim 16, further comprising a second rocker assembly mounted to the drum and configured to pivot about a pivot axis parallel to a rotational axis of the drum, the second rocker assembly including a second retractable knife, wherein the first and second retractable knives are evenly spaced from one another about the circumference of the drum.

18. The apparatus of claim 14, wherein the adhesive applicator is positioned to apply an adhesive at least to opposing ends of a severed label after the label is severed by the cutter mechanism, and wherein the knife retraction mechanism is configured to selectively retract the retractable knife within the outer surface of the drum proximate the adhesive applicator.

19. The apparatus of claim 18, wherein the outer surface of the drum includes raised pads for engaging the opposing ends of a severed label from the web of material.

20. The apparatus of claim 1, further comprising a conveyor configured to pass a container past the drum to engage the label after the application of adhesive and thereby transfer the label to an outer surface of the container.

21. An apparatus, comprising:

(a) a web supply configured to supply a web of material;

(b) a rotatable drum configured to receive the web of material, the drum including an outer surface;

(c) a first drive mechanism coupled to the drum and configured to continuously rotate the drum and advance the outer surface thereof at a first predetermined rate;

(d) a second drive mechanism configured to continuously advance the web of material at a second predetermined rate, wherein the first and second predetermined rates are different from one another;

(e) a cutter mechanism configured to sever a segment from the web of material at a predetermined rotational position of the drum while at least a portion of the web of material engages the outer surface of the drum;

(f) a controller configured to dynamically control at least one of the first and second drive mechanisms such that a predetermined length of material is advanced forward of the predetermined rotational position of the drum as such time as the drum is positioned at the predetermined rotational position; and (g) a linear feed rate sensor disposed between the web supply and the drum and coupled to the controller, the linear feed rate sensor generating an output signal associated with a linear feed rate for the web of material.

22. The apparatus of claim 21, further comprising an attraction mechanism disposed on the outer surface of the drum and configured to attract the web of material to the outer surface of the drum, and wherein the controller is configured to rotate the drum and advance the outer surface thereof at a rate greater than a rate at which the web of material is advanced from the web supply such that the web of material is in sliding engagement with the outer surface of the drum.

23. The apparatus of claim 22, wherein the attraction of the web of material to the drum is the sole source of tension between the web supply and the drum.

24. The apparatus of claim 21, further comprising:

(a) a first sensor coupled to the first drive mechanism to sense rotation of the drum and provide an indication of the same to the controller; and (b) a registration sensor configured to detect registration indicia located at predetermined positions on the web of material and provide an indication of the same to the controller, wherein the controller is further configured to selectively advance or retard advance of the web of material relative to rotation of the drum so as to sever the web of material at a predetermined position thereon relative to the registration indicia.

25. The apparatus of claim 24, wherein the linear feed rate sensor includes a free wheeling roller engaging the web of material between the web supply and the drum and coupled to a rotational position sensor, wherein the free wheeling roller has a fixed diameter such that a linear feed rate for the web of material may be calculated by sensing the rate of rotation of the free wheeling roller.

26. The apparatus of claim 24, wherein the controller is further responsive to a length input representative of a desired length at which to sever segments from the web of material.

27. The apparatus of claim 21, wherein the web of material includes a sequence of unsevered labels, and wherein the apparatus further comprises:

(a) an adhesive applicator positioned proximate the drum to apply an adhesive to at least a portion of the segment; and (b) a conveyor configured to pass a container past the drum to engage the segment after the application of adhesive and thereby transfer the segment to an outer surface of the container.

28. A labeling apparatus, comprising:

(a) a web supply configured to supply a web of label material, the label material including indicia disposed at predetermined positions thereon, the web supply including a supply roll;

(b) a rotatable drum configured to receive the web of material, the drum including an outer surface providing a source of attraction for the web of label material;

(c) a registration sensor configured to detect the indicia on the web of label material;

(d) a first drive mechanism coupled to the drum and configured to rotate the drum at a first predetermined rate;

(e) a second drive mechanism coupled directly to the supply roll of the web supply and configured to supply the web of label material at a second predetermined rate, wherein the first predetermined rate is greater than the second predetermined rate;

(f) a stationary knife disposed proximate the drum at a stationary position;

(g) a retractable knife coupled to the drum and configured to rotate with the drum and engage the stationary knife when the drum is disposed at a predetermined rotational position;

(h) a linear feed rate sensor disposed between the web supply and the drum and coupled to a controller, the linear feed rate sensor generating an output signal associated with a linear feed rate for the web of material; and (i) the controller, coupled to the linear feed rate sensor, the first and second drive mechanisms and the registration sensor, the controller configured to control at least one of the first and second predetermined rates such that a desired length of label material is advanced forward of the rotating knife on the drum as the rotating knife engages the stationary knife at the predetermined rotational position of the drum and thereby severs the desired length of label material from the web of material.

29. A method of severing labels of predetermined length from a web of material, the method comprising:

(a) advancing a web of material toward a rotating drum, the web of material including a sequence of unsevered labels;

(b) attracting the web of material into engagement with the outer surface of the drum;

(c) severing a label from the web of material while at least a portion of the web of material engages the outer surface of the drum using a retractable knife coupled to the drum and configured to rotate with the drum;

(d) rotating the drum and advancing the outer surface thereof at a rate greater than the rate at which the web of material is advanced from the web supply;

(e) applying an adhesive with an adhesive applicator to at least a portion of the label while at least a portion of the label engages the outer surface of the drum; and (f) retracting the retractable knife within the outer surface of the drum when the knife is proximate the adhesive applicator.

30. The method of claim 29, further comprising:

(a) driving a web supply with a drive mechanism; and (b) sensing the rate of rotation of the drive mechanism.

31. The method of claim 29, further comprising sensing the rate of rotation of the drum.

32. The method of claim 29, further comprising sensing a linear feed rate for the web of material using a rotational sensor coupled to a free wheeling roller having a fixed diameter and engaging the web of material upstream of the drum.

33. The method of claim 29, wherein severing the segment includes severing the segment at when the drum is disposed at a predetermined rotational position.

34. The method of claim 29, further comprising detecting registration indicia located at predetermined positions on the web of material at a location upstream of the drum.

35. The method of claim 29, further comprising receiving a length input associated with a desired length of the segment severed from the web of material.

36. The method of claim 29, further comprising transferring the label from the drum to a surface of a container after application of adhesive.

37. A method of severing segments of predetermined length from a web of material, the method comprising:

(a) continuously rotating a drum at a first predetermined rate;

(b) continuously advancing a web of material at a second predetermined rate such that the web of material engages an outer surface of the drum, wherein the first and second predetermined rates are different;

(c) severing a segment from the web of material at a predetermined rotational position of the drum and as at least a portion of the web of material engages the outer surface of the drum;

(d) dynamically controlling at least one of the first and second predetermined rates such that a predetermined length of material is advanced forward of the predetermined rotational position of the drum as such time as the drum is positioned at the predetermined rotational position; and (e) sensing the second predetermined rate using a rotational sensor coupled to a free wheeling roller having a fixed diameter and engaging the web of material upstream of the drum.

38. A method of severing segments of predetermined length from a web of material, the method comprising:

(a) continuously rotating a drum at a first predetermined rate;

(b) continuously advancing a web of material at a second predetermined rate such that the web of material engages an outer surface of the drum, wherein the first and second predetermined rates are different;

(c) severing a segment from the web of material at a predetermined rotational position of the drum and as at least a portion of the web of material engages the outer surface of the drum;

(d) dynamically controlling at least one of the first and second predetermined rates such that a predetermined length of material is advanced forward of the predetermined rotational position of the drum as such time as the drum is positioned at the predetermined rotational position; and (e) attracting the web of material into engagement with the outer surface of the drum, wherein dynamically controlling includes rotating the drum and advancing the outer surface thereof at a rate greater than the rate at which the web of material is advanced from the web supply, and wherein the attraction of the web of material to the drum is the sole source of tension between the web supply and the drum.

39. The method of claim 37, further comprising:

(a) sensing the first predetermined rate using a first rotational sensor configured to sense a rate of rotation for the drum; and (b) detecting registration indicia located at predetermined positions on the web of material at a location upstream of the drum, wherein dynamically controlling is responsive to the first and second predetermined rates and the location of the registration indicia on the web of material.

40. The method of claim 39, further comprising receiving a length input associated with a desired length of the segment severed from the web of material, wherein dynamically controlling is further responsive to the length input.

41. The method of claim 39, further comprising:

(a) advancing the web of material using a drive mechanism coupled to a web supply; and (b) sensing a rate of rotation of the drive mechanism, wherein dynamically controlling is further responsive to the rate of rotation of the drive mechanism.

42. The method of claim 37, further comprising:

(a) applying an adhesive to at least a portion of the segment while the segment is disposed on the outer surface of the drum; and (b) transferring the segment from the drum to a surface of a container after the application of adhesive.

43. The apparatus of claim 1, wherein the attraction of the web of material to the drum is the sole source of tension between the web supply and the drum.

44. An apparatus, comprising:

(a) a web supply configured to supply a web of material, the web of material including a sequence of unsevered labels;

(b) a rotatable drum configured to receive the web of material, the drum including an outer surface;

(c) an attraction mechanism disposed on the outer surface of the drum and configured to attract the web of material to the outer surface of the drum;

(d) a drive mechanism coupled to the drum and configured to rotate the drum and advance the outer surface thereof at a rate greater than a rate at which the web of material is advanced from the web supply;

(e) a cutter mechanism coupled to the drum and configured to sever a label from the web of material while at least a portion of the web of material engages the outer surface of the drum, the cutter mechanism including a retractable knife disposed on the drum and configured to rotate with the drum; and (f) an application station configured to pass a container past the drum to engage the label and thereby transfer the segment from the outer surface of the drum to an outer surface of the container.

45. The apparatus of claim 44, further comprising an adhesive applicator positioned proximate the drum to apply an adhesive to at least a portion of the label prior to transfer of the label to the outer surface of the container.

46. An apparatus, comprising:

(a) a web supply configured to supply a web of material;

(b) a rotatable drum configured to receive the web of material, the drum including an outer surface;

(c) an attraction mechanism disposed on the outer surface of the drum and configured to attract the web of material to the outer surface of the drum;

(d) a drive mechanism coupled to the drum and configured to rotate the drum and advance the outer surface thereof at a rate greater than a rate at which the web of material is advanced from the web supply, wherein the attraction of the web of material to the drum is the sole source of tension between the web supply and the drum;

(e) a cutter mechanism coupled to the drum and configured to sever a segment from the web of material while at least a portion of the web of material engages the outer surface of the drum, wherein the cutter mechanism includes a knife configured to rotate with the drum and sever the segment from the web of material at a predetermined rotational position of the drum, wherein the knife is a retractable knife coupled to the drum, wherein the cutter mechanism further includes a knife retraction mechanism, coupled to the retractable knife and configured to selectively retract the knife within the outer surface of the drum, wherein the web of material includes a sequence of unsevered labels, and wherein the cutter mechanism severs labels from the web of material;

(f) an adhesive applicator positioned proximate the drum to apply an adhesive to at least a portion of the segment; and (g) a conveyor configured to pass a container past the, drun to engage the segment after the application of adhesive and thereby transfer the segment to an outer surface of the container.

47. The apparatus of claim 21, wherein the web supply includes a supply roll, and wherein the second drive mechanism is directly coupled to the supply roll.

48. The labeling apparatus of claim 28, wherein the attraction of the web of label material to the drum is the sole source of tension between the web supply and the drum.

49. An apparatus, comprising:

(a) a web supply configured to supply a web of material;

(b ) a rotatable drum configured to receive the web of material, the drum including an outer surface;

(c) an attraction mechanism disposed on the outer surface of the drum and configured to attract the web of material to the outer surface of the drum;

(d) a drive mechanism coupled to the drum and configured to rotate the drum and advance the outer surface thereof at a rate greater than a rate at which the web of material is advanced from the web supply; and (e) a cutter mechanism coupled to the drum and configured to sever a segment from the web of material while at least a portion of the web of material engages the outer surface of the drum, the cutter mechanism including:

(i) a retractable knife coupled to the drum and configured to rotate with the drum, the retractable knife configured to sever the segment from the web of material at a predetermined rotational position of the drum; and (ii) a knife retraction mechanism, coupled to the retractable knife and configured to selectively retract the knife within the outer surface of the drum, the knife retraction mechanism including a rocker assembly mounted to the drum and configured to pivot about a pivot axis parallel to a rotational axis of the drum.

50. The apparatus of claim 49, wherein the web of material includes a sequence of unsevered labels, wherein the apparatus further comprises an adhesive applicator positioned proximate the drum to apply an adhesive to at least a portion of the label while at least a portion of the label engages the outer surface of the drum, and wherein the knife retraction mechanism is configured to selectively retract the retractable knife within the outer surface of the drum proximate the adhesive applicator.

51. The apparatus of claim 49, wherein the knife retraction mechanism includes a fixed cam disposed about a rotational shaft of the drum, wherein the rocker assembly is coupled to the retractable knife at a first end thereof and a cam follower at a second end thereof that follows the fixed cam as the drum rotates about the rotational shaft, wherein the retractable knife is selectively extended and retracted through rotation of the drum about the rotational shaft.

52. The method of claim 29, wherein the attraction of the web of material to the drum is the sole source of tension between the web supply and the drum.

53. The method of claim 29, wherein the web of material is disposed on a supply roll, and advancing the web of material toward the rotating drum includes directly driving the supply roll.

54. method of severing labels of predetermined length from a web of material, the method comprising:

(a) advancing a web of material toward a rotating drum, the web of material including a sequence of unsevered labels;

(b) attracting the web of material into engagement with the outer surface of the drum;

(c) severing a label from the web of material while at least a portion of the web of material engages the outer surface of the drum using a retractable knife coupled to the drum and configured to rotate with the drum;

(d) rotating the drum and advancing the outer surface thereof at a rate greater than the rate at which the web of material is advanced from the web supply; and (e) transferring the label from the drum to a surface of a container.

55. The method of claim 54, further comprising applying an adhesive to at least a portion of the segment while the segment is disposed on the outer surface of the drum.

56. The method of claim 54, wherein the web of material is disposed on a supply roll, and advancing the web of material toward the rotating drum includes directly driving the supply roll.

57. The method of claim 41, wherein the web supply includes a supply roll, and wherein advancing the web of material using the drive mechanism includes directly driving the supply roll.

58. A method of severing segments of predetermined length from a web of material, the method comprising:

(a) continuously rotating a drum at a first predetermined rate;

(b) continuously advancing a web of material at a second predetermined rate such that the web of material engages an outer surface of the drum, wherein the first and second predetermined rates are different;

(c) severing a segment from the web of material at a first predetermined rotational position of the drum and as at least a portion of the web of material engages the outer surface using a retractable knife coupled to the drum and configured to rotate with the drum;

(d) retracting the knife within the outer surface of the drum at a second predetermined position of the drum via pivoting motion of the knife about a pivot axis oriented parallel to a rotational axis of the drum; and (e) dynamically controlling at least one of the first and second predetermined rates such that a predetermined length of material is advanced forward of the predetermined rotational position of the drum as such time as the drum is positioned at the first predetermined rotational position.

59. The method of claim 58, further comprising applying an adhesive to at least a portion of the label proximate the second predetermined rotational position of the drum.

60. The method of claim 88, wherein retracting the knife is performed by a knife retraction mechanism that includes a fixed cam disposed about a rotational shaft of the drum and a rocker assembly mounted to the drum and configured to pivot about the pivot axis, the rocker assembly including the retractable knife at a first end thereof and a cam follower at a second end thereof that follows the fixed cam as the drum rotates about the rotational shaft, wherein the retractable knife is selectively extended and retracted through rotation of the drum about the rotational shaft.

61. The method of claim 54, further comprising transferring the label from the drum to a surface of a container.

* * * * *

UNITED STATES PATENT AND TRADEMARK OFFICE

CERTIFICATE OF CORRECTION

PATENT NO. : 6,328,832 B1
DATED : December 11, 2001
INVENTOR(S) : Otruba et al.

It is certified that error appears in the above-identified patent and that said Letters Patent is hereby corrected as shown below:

Column 1,
Line 7, reads "invention is generally" and should read -- The invention is generally --.

Column 4,
Line 9, reads "The clamming mechanism" and should read -- The camming mechanism --.

Column 5,
Line 2, reads "the clamming mechanism" and should read -- the camming mechanism --.
Line 23, reads "the cylindncal" and should read -- cylindrical --.

Column 7,
Line 4, reads "diagrmmatically" and should read -- diagrammatically --.

Column 8,
Line 41, reads "configured similarly" and should read -- is configured similarly --.

Column 9,
Line 9, reads "vacuwn" and should read -- vacuum --.

Column 10,
Line 63, reads "$R_o$=$L_o$(π" and should read -- $R_o = L_o/(\pi$ --.

Column 12,
Line 13, reads "has been set During" and should read -- has been set. During --.

Column 13,
Line 57, reads "clamming" and should read -- camming --.

Column 14,
Line 40, reads "thereof In the" and should read -- thereof. In the --.

Column 15,
Line 46, reads "100. Then a new paragraph is started with 'Assuming'" There should be no new paragraph separating the sentence here.

UNITED STATES PATENT AND TRADEMARK OFFICE

CERTIFICATE OF CORRECTION

PATENT NO. : 6,328,832 B1
DATED : December 11, 2001
INVENTOR(S) : Otruba et al.

It is certified that error appears in the above-identified patent and that said Letters Patent is hereby corrected as shown below:

Column 18,
Line 3, reads "FIG. 1 Specifically," and should read -- FIG 1. Specifically, --.

Column 24,
Line 52, reads "past the, drun" and should read -- past the drum --.

Column 25,
Line 45, reads "method of" and should read -- A method of --.

Column 26,
Line 43, reads "The method of claim 88" and should read -- The method of claim 58 --.

Signed and Sealed this

Twentieth Day of August, 2002

*Attest:*

*Attesting Officer*

JAMES E. ROGAN
*Director of the United States Patent and Trademark Office*